US006710755B1

(12) United States Patent
Shiozaki et al.

(10) Patent No.: US 6,710,755 B1
(45) Date of Patent: Mar. 23, 2004

(54) METHOD FOR DRIVING PLASMA DISPLAY PANEL

(75) Inventors: Yuya Shiozaki, Yamanashi (JP); Tsutomu Tokunaga, Yamanashi (JP); Nobuhiko Saegusa, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 279 days.

(21) Appl. No.: 09/685,893

(22) Filed: Oct. 11, 2000

(30) Foreign Application Priority Data

Oct. 12, 1999 (JP) ..... 11-289864
Dec. 17, 1999 (JP) ..... 11-358756

(51) Int. Cl.[7] ..... G09G 3/28

(52) U.S. Cl. ..... 345/60; 345/63; 345/67; 345/68; 315/169.4; 313/582; 313/584

(58) Field of Search ..... 345/60, 63, 66, 345/67, 68; 315/169.4; 313/582, 583, 584, 585, 586, 587

(56) References Cited

U.S. PATENT DOCUMENTS 5,684,499 A * 11/1997 Shimizu et al. ..... 345/60
5,854,540 A * 12/1998 Matsumoto et al. ..... 315/169.1
5,877,734 A * 3/1999 Amemiya ..... 345/60
6,262,699 B1 * 7/2001 Suzuki et al. ..... 345/68
6,362,800 B1 * 3/2002 Moon ..... 345/60

* cited by examiner

*Primary Examiner*—Amare Mengistu
*Assistant Examiner*—Jimmy H. Nguyen
(74) *Attorney, Agent, or Firm*—Morgan, Lewis & Bockius LLP

(57) ABSTRACT

A plasma display panel drive method by which good image displays can be performed even when the pulse widths of drive pulses applied to the plasma display panel are made short. Each time the execution of pixel data writing on one display line group among a plurality of display lines of the plasma display panel is completed, a sustained discharge operation is executed on each of the emitting cells belonging to that one display line group.

12 Claims, 22 Drawing Sheets

FIG. 7

| LUMINANCE | D | LUMINANCE | DH | LUMINANCE | D | LUMINANCE | DH |
|---|---|---|---|---|---|---|---|
| | 0 ~ 7 | | 0 ~ 7 | | 0 ~ 7 | | 0 ~ 7 |
| 0 | 00000000 | 0 | 00000000 | 64 | 01000000 | 56 | 00111000 |
| 1 | 00000001 | 0 | 00000000 | 65 | 01000001 | 57 | 00111001 |
| 2 | 00000010 | 1 | 00000001 | 66 | 01000010 | 57 | 00111001 |
| 3 | 00000011 | 2 | 00000010 | 67 | 01000011 | 58 | 00111010 |
| 4 | 00000100 | 3 | 00000011 | 68 | 01000100 | 59 | 00111011 |
| 5 | 00000101 | 4 | 00000100 | 69 | 01000101 | 60 | 00111100 |
| 6 | 00000110 | 5 | 00000101 | 70 | 01000110 | 61 | 00111101 |
| 7 | 00000111 | 6 | 00000110 | 71 | 01000111 | 62 | 00111110 |
| 8 | 00001000 | 7 | 00000111 | 72 | 01001000 | 63 | 00111111 |
| 9 | 00001001 | 7 | 00000111 | 73 | 01001001 | 64 | 01000000 |
| 10 | 00001010 | 8 | 00001000 | 74 | 01001010 | 65 | 01000001 |
| 11 | 00001011 | 9 | 00001001 | 75 | 01001011 | 65 | 01000001 |
| 12 | 00001100 | 10 | 00001010 | 76 | 01001100 | 66 | 01000010 |
| 13 | 00001101 | 11 | 00001011 | 77 | 01001101 | 67 | 01000011 |
| 14 | 00001110 | 12 | 00001100 | 78 | 01001110 | 68 | 01000100 |
| 15 | 00001111 | 13 | 00001101 | 79 | 01001111 | 69 | 01000101 |
| 16 | 00010000 | 14 | 00001110 | 80 | 01010000 | 70 | 01000110 |
| 17 | 00010001 | 14 | 00001110 | 81 | 01010001 | 71 | 01000111 |
| 18 | 00010010 | 15 | 00001111 | 82 | 01010010 | 72 | 01001000 |
| 19 | 00010011 | 16 | 00010000 | 83 | 01010011 | 72 | 01001000 |
| 20 | 00010100 | 17 | 00010001 | 84 | 01010100 | 73 | 01001001 |
| 21 | 00010101 | 18 | 00010010 | 85 | 01010101 | 74 | 01001010 |
| 22 | 00010110 | 19 | 00010011 | 86 | 01010110 | 75 | 01001011 |
| 23 | 00010111 | 20 | 00010100 | 87 | 01010111 | 76 | 01001100 |
| 24 | 00011000 | 21 | 00010101 | 88 | 01011000 | 77 | 01001101 |
| 25 | 00011001 | 21 | 00010101 | 89 | 01011001 | 77 | 01001101 |
| 26 | 00011010 | 22 | 00010110 | 90 | 01011010 | 78 | 01001110 |
| 27 | 00011011 | 23 | 00010111 | 91 | 01011011 | 79 | 01001111 |
| 28 | 00011100 | 24 | 00011000 | 92 | 01011100 | 80 | 01010000 |
| 29 | 00011101 | 25 | 00011001 | 93 | 01011101 | 81 | 01010001 |
| 30 | 00011110 | 26 | 00011010 | 94 | 01011110 | 82 | 01010010 |
| 31 | 00011111 | 27 | 00011011 | 95 | 01011111 | 83 | 01010011 |
| 32 | 00100000 | 28 | 00011100 | 96 | 01100000 | 84 | 01010100 |
| 33 | 00100001 | 28 | 00011100 | 97 | 01100001 | 85 | 01010101 |
| 34 | 00100010 | 29 | 00011101 | 98 | 01100010 | 86 | 01010110 |
| 35 | 00100011 | 30 | 00011110 | 99 | 01100011 | 86 | 01010110 |
| 36 | 00100100 | 31 | 00011111 | 100 | 01100100 | 87 | 01010111 |
| 37 | 00100101 | 32 | 00100000 | 101 | 01100101 | 88 | 01011000 |
| 38 | 00100110 | 33 | 00100001 | 102 | 01100110 | 89 | 01011001 |
| 39 | 00100111 | 34 | 00100010 | 103 | 01100111 | 90 | 01011010 |
| 40 | 00101000 | 35 | 00100011 | 104 | 01101000 | 91 | 01011011 |
| 41 | 00101001 | 36 | 00100100 | 105 | 01101001 | 92 | 01011100 |
| 42 | 00101010 | 36 | 00100100 | 106 | 01101010 | 93 | 01011101 |
| 43 | 00101011 | 37 | 00100101 | 107 | 01101011 | 93 | 01011101 |
| 44 | 00101100 | 38 | 00100110 | 108 | 01101100 | 94 | 01011110 |
| 45 | 00101101 | 39 | 00100111 | 109 | 01101101 | 95 | 01011111 |
| 46 | 00101110 | 40 | 00101000 | 110 | 01101110 | 96 | 01100000 |
| 47 | 00101111 | 41 | 00101001 | 111 | 01101111 | 97 | 01100001 |
| 48 | 00110000 | 42 | 00101010 | 112 | 01110000 | 98 | 01100010 |
| 49 | 00110001 | 43 | 00101011 | 113 | 01110001 | 99 | 01100011 |
| 50 | 00110010 | 43 | 00101011 | 114 | 01110010 | 100 | 01100100 |
| 51 | 00110011 | 44 | 00101100 | 115 | 01110011 | 101 | 01100101 |
| 52 | 00110100 | 45 | 00101101 | 116 | 01110100 | 101 | 01100101 |
| 53 | 00110101 | 46 | 00101110 | 117 | 01110101 | 102 | 01100110 |
| 54 | 00110110 | 47 | 00101111 | 118 | 01110110 | 103 | 01100111 |
| 55 | 00110111 | 48 | 00110000 | 119 | 01110111 | 104 | 01101000 |
| 56 | 00111000 | 49 | 00110001 | 120 | 01111000 | 105 | 01101001 |
| 57 | 00111001 | 50 | 00110010 | 121 | 01111001 | 106 | 01101010 |
| 58 | 00111010 | 50 | 00110010 | 122 | 01111010 | 107 | 01101011 |
| 59 | 00111011 | 51 | 00110011 | 123 | 01111011 | 108 | 01101100 |
| 60 | 00111100 | 52 | 00110100 | 124 | 01111100 | 108 | 01101100 |
| 61 | 00111101 | 53 | 00110101 | 125 | 01111101 | 109 | 01101101 |
| 62 | 00111110 | 54 | 00110110 | 126 | 01111110 | 110 | 01101110 |
| 63 | 00111111 | 55 | 00110111 | 127 | 01111111 | 111 | 01101111 |

FIG. 8

| LUMINANCE | D | LUMINANCE | DH | LUMINANCE | D | LUMINANCE | DH |
|---|---|---|---|---|---|---|---|
| | 0 ~ 7 | | 0 ~ 7 | | 0 ~ 7 | | 0 ~ 7 |
| 128 | 10000000 | 112 | 01110000 | 192 | 11000000 | 168 | 10101000 |
| 129 | 10000001 | 113 | 01110001 | 193 | 11000001 | 169 | 10101001 |
| 130 | 10000010 | 114 | 01110010 | 194 | 11000010 | 170 | 10101010 |
| 131 | 10000011 | 115 | 01110011 | 195 | 11000011 | 171 | 10101011 |
| 132 | 10000100 | 115 | 01110011 | 196 | 11000100 | 172 | 10101100 |
| 133 | 10000101 | 116 | 01110100 | 197 | 11000101 | 173 | 10101101 |
| 134 | 10000110 | 117 | 01110101 | 198 | 11000110 | 173 | 10101101 |
| 135 | 10000111 | 118 | 01110110 | 199 | 11000111 | 174 | 10101110 |
| 136 | 10001000 | 119 | 01110111 | 200 | 11001000 | 175 | 10101111 |
| 137 | 10001001 | 120 | 01111000 | 201 | 11001001 | 176 | 10110000 |
| 138 | 10001010 | 121 | 01111001 | 202 | 11001010 | 177 | 10110001 |
| 139 | 10001011 | 122 | 01111010 | 203 | 11001011 | 178 | 10110010 |
| 140 | 10001100 | 122 | 01111010 | 204 | 11001100 | 179 | 10110011 |
| 141 | 10001101 | 123 | 01111011 | 205 | 11001101 | 180 | 10110100 |
| 142 | 10001110 | 124 | 01111100 | 206 | 11001110 | 180 | 10110100 |
| 143 | 10001111 | 125 | 01111101 | 207 | 11001111 | 181 | 10110101 |
| 144 | 10010000 | 126 | 01111110 | 208 | 11010000 | 182 | 10110110 |
| 145 | 10010001 | 127 | 01111111 | 209 | 11010001 | 183 | 10110111 |
| 146 | 10010010 | 128 | 10000000 | 210 | 11010010 | 184 | 10111000 |
| 147 | 10010011 | 129 | 10000001 | 211 | 11010011 | 185 | 10111001 |
| 148 | 10010100 | 130 | 10000010 | 212 | 11010100 | 186 | 10111010 |
| 149 | 10010101 | 130 | 10000010 | 213 | 11010101 | 187 | 10111011 |
| 150 | 10010110 | 131 | 10000011 | 214 | 11010110 | 187 | 10111011 |
| 151 | 10010111 | 132 | 10000100 | 215 | 11010111 | 188 | 10111100 |
| 152 | 10011000 | 133 | 10000101 | 216 | 11011000 | 189 | 10111101 |
| 153 | 10011001 | 134 | 10000110 | 217 | 11011001 | 190 | 10111110 |
| 154 | 10011010 | 135 | 10000111 | 218 | 11011010 | 191 | 10111111 |
| 155 | 10011011 | 136 | 10001000 | 219 | 11011011 | 192 | 11000000 |
| 156 | 10011100 | 137 | 10001001 | 220 | 11011100 | 193 | 11000001 |
| 157 | 10011101 | 137 | 10001001 | 221 | 11011101 | 194 | 11000010 |
| 158 | 10011110 | 138 | 10001010 | 222 | 11011110 | 195 | 11000011 |
| 159 | 10011111 | 139 | 10001011 | 223 | 11011111 | 195 | 11000011 |
| 160 | 10100000 | 140 | 10001100 | 224 | 11100000 | 196 | 11000100 |
| 161 | 10100001 | 141 | 10001101 | 225 | 11100001 | 197 | 11000101 |
| 162 | 10100010 | 142 | 10001110 | 226 | 11100010 | 198 | 11000110 |
| 163 | 10100011 | 143 | 10001111 | 227 | 11100011 | 199 | 11000111 |
| 164 | 10100100 | 144 | 10010000 | 228 | 11100100 | 200 | 11001000 |
| 165 | 10100101 | 144 | 10010000 | 229 | 11100101 | 201 | 11001001 |
| 166 | 10100110 | 145 | 10010001 | 230 | 11100110 | 202 | 11001010 |
| 167 | 10100111 | 146 | 10010010 | 231 | 11100111 | 202 | 11001010 |
| 168 | 10101000 | 147 | 10010011 | 232 | 11101000 | 203 | 11001011 |
| 169 | 10101001 | 148 | 10010100 | 233 | 11101001 | 204 | 11001100 |
| 170 | 10101010 | 149 | 10010101 | 234 | 11101010 | 205 | 11001101 |
| 171 | 10101011 | 150 | 10010110 | 235 | 11101011 | 206 | 11001110 |
| 172 | 10101100 | 151 | 10010111 | 236 | 11101100 | 207 | 11001111 |
| 173 | 10101101 | 151 | 10010111 | 237 | 11101101 | 208 | 11010000 |
| 174 | 10101110 | 152 | 10011000 | 238 | 11101110 | 209 | 11010001 |
| 175 | 10101111 | 153 | 10011001 | 239 | 11101111 | 209 | 11010001 |
| 176 | 10110000 | 154 | 10011010 | 240 | 11110000 | 210 | 11010010 |
| 177 | 10110001 | 155 | 10011011 | 241 | 11110001 | 211 | 11010011 |
| 178 | 10110010 | 156 | 10011100 | 242 | 11110010 | 212 | 11010100 |
| 179 | 10110011 | 157 | 10011101 | 243 | 11110011 | 213 | 11010101 |
| 180 | 10110100 | 158 | 10011110 | 244 | 11110100 | 214 | 11010110 |
| 181 | 10110101 | 158 | 10011110 | 245 | 11110101 | 215 | 11010111 |
| 182 | 10110110 | 159 | 10011111 | 246 | 11110110 | 216 | 11011000 |
| 183 | 10110111 | 160 | 10100000 | 247 | 11110111 | 216 | 11011000 |
| 184 | 10111000 | 161 | 10100001 | 248 | 11111000 | 217 | 11011010 |
| 185 | 10111001 | 162 | 10100010 | 249 | 11111001 | 218 | 11011010 |
| 186 | 10111010 | 163 | 10100011 | 250 | 11111010 | 219 | 11011011 |
| 187 | 10111011 | 164 | 10100100 | 251 | 11111011 | 220 | 11011100 |
| 188 | 10111100 | 165 | 10100101 | 252 | 11111100 | 221 | 11011101 |
| 189 | 10111101 | 166 | 10100110 | 253 | 11111101 | 222 | 11011110 |
| 190 | 10111110 | 166 | 10100110 | 254 | 11111110 | 223 | 11011111 |
| 191 | 10111111 | 167 | 10100111 | 255 | 11111111 | 224 | 11100000 |

FIG.13

GRADATION

[SELECTIVE ERASURE]

EMISSION LUMINOSITY

| | CONVERSION TABLE OF SECOND DATA CONVERSION CIRCUIT 34 | | | | | | | | | | | | | | | EMISSION DRIVE PATTERN FOR ONE FIELD | | | | | | | | | | | | | | |
|---|---|---|---|---|---|---|---|---|---|---|---|---|---|---|---|---|---|---|---|---|---|---|---|---|---|---|---|---|---|---|
| | Ds | GD 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 1 | 0000 | 1 | 0 | 0 | 0 | 0 | 0 | 0 | 0 | 0 | 0 | 0 | 0 | 0 | 0 | ● | | | | | | | | | | | | | | 0 |
| 2 | 0001 | 0 | 1 | 0 | 0 | 0 | 0 | 0 | 0 | 0 | 0 | 0 | 0 | 0 | 0 | ○ | ● | | | | | | | | | | | | | 1 |
| 3 | 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 4 | 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 5 | 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 6 | 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 7 | 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 8 | 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 9 | 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 10 | 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 11 | 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 12 | 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 13 | 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 14 | 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 15 | 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

FILLED CIRCLE: SELECTIVE ERASURE DISCHARGE
UNFIELD CIRCLE: EMISSION SF

FIG.16

| | SF1 | SF2 | SF3 | SF4 | SF5 | SF6 | SF7 | SF8 | SF9 | SF10 | SF11 | SF12 | SF13 | SF14 |
|---|---|---|---|---|---|---|---|---|---|---|---|---|---|---|
| I 1 | 2 | 2 | 2 | 2 | 2 | 2 | 2 | 2 | 2 | 2 | 2 | 2 | 2 | 2 |
| I 2 | | 8 | 16 | 28 | 36 | 48 | 60 | 72 | 84 | 96 | 108 | 124 | 136 | 154 |
| I 3 | 2 | 2 | 2 | 2 | 2 | 2 | 2 | 2 | 2 | 2 | 2 | 2 | 2 | |
| | 4 | 12 | 20 | 32 | 40 | 52 | 64 | 76 | 88 | 100 | 112 | 128 | 140 | 156 |
| | 1 | 3 | 5 | 8 | 10 | 13 | 16 | 19 | 22 | 25 | 28 | 32 | 35 | 39 |

EMISSION LUMINANCE RATIO

TOTAL NUMBER OF TIMES OF EMISSION

FIG.17

GRADATION

[SELECTIVE ERASURE]

EMISSION LUMINOSITY

| | CONVERSION TABLE OF SECOND DATA CONVERSION CIRCUIT 34 | | | | | | | | | | | | | | | EMISSION DRIVE PATTERN FOR ONE FIELD | | | | | | | | | | | | | | |
|---|---|---|---|---|---|---|---|---|---|---|---|---|---|---|---|---|---|---|---|---|---|---|---|---|---|---|---|---|---|---|
| | Ds | GD 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 1 | 0000 | 1 | 1 | * | * | * | * | * | * | * | * | * | * | * | * | ● | ● | △ | △ | △ | △ | △ | △ | △ | △ | △ | △ | △ | △ | 0 |
| 2 | 0001 | 0 | 1 | 1 | * | * | * | * | * | * | * | * | * | * | * | ○ | ● | ● | △ | △ | △ | △ | △ | △ | △ | △ | △ | △ | △ | 1 |
| 3 | 0010 | 0 | 0 | 1 | 1 | * | * | * | * | * | * | * | * | * | * | ○ | ○ | ● | ● | △ | △ | △ | △ | △ | △ | △ | △ | △ | △ | 4 |
| 4 | 0011 | 0 | 0 | 0 | 1 | 1 | * | * | * | * | * | * | * | * | * | ○ | ○ | ○ | ● | ● | △ | △ | △ | △ | △ | △ | △ | △ | △ | 9 |
| 5 | 0100 | 0 | 0 | 0 | 0 | 1 | 1 | * | * | * | * | * | * | * | * | ○ | ○ | ○ | ○ | ● | ● | △ | △ | △ | △ | △ | △ | △ | △ | 17 |
| 6 | 0101 | 0 | 0 | 0 | 0 | 0 | 1 | 1 | * | * | * | * | * | * | * | ○ | ○ | ○ | ○ | ○ | ● | ● | △ | △ | △ | △ | △ | △ | △ | 27 |
| 7 | 0110 | 0 | 0 | 0 | 0 | 0 | 0 | 1 | 1 | * | * | * | * | * | * | ○ | ○ | ○ | ○ | ○ | ○ | ● | ● | △ | △ | △ | △ | △ | △ | 40 |
| 8 | 0111 | 0 | 0 | 0 | 0 | 0 | 0 | 0 | 1 | 1 | * | * | * | * | * | ○ | ○ | ○ | ○ | ○ | ○ | ○ | ● | ● | △ | △ | △ | △ | △ | 56 |
| 9 | 1000 | 0 | 0 | 0 | 0 | 0 | 0 | 0 | 0 | 1 | 1 | * | * | * | * | ○ | ○ | ○ | ○ | ○ | ○ | ○ | ○ | ● | ● | △ | △ | △ | △ | 75 |
| 10 | 1001 | 0 | 0 | 0 | 0 | 0 | 0 | 0 | 0 | 0 | 1 | 1 | * | * | * | ○ | ○ | ○ | ○ | ○ | ○ | ○ | ○ | ○ | ● | ● | △ | △ | △ | 97 |
| 11 | 1010 | 0 | 0 | 0 | 0 | 0 | 0 | 0 | 0 | 0 | 0 | 1 | 1 | * | * | ○ | ○ | ○ | ○ | ○ | ○ | ○ | ○ | ○ | ○ | ● | ● | △ | △ | 122 |
| 12 | 1011 | 0 | 0 | 0 | 0 | 0 | 0 | 0 | 0 | 0 | 0 | 0 | 1 | 1 | * | ○ | ○ | ○ | ○ | ○ | ○ | ○ | ○ | ○ | ○ | ○ | ● | ● | △ | 150 |
| 13 | 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 182 |
| 14 | 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 15 | 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

FILLED CIRCLE: SELECTIVE ERASURE DISCHARGE
UNFILLED CIRCLE: EMISSION

FIG. 21

| | | SF1 | SF2 | SF3 | SF4 | SF5 | SF6 | SF7 | SF8 | SF9 | SF10 | SF11 | SF12 | SF13 | SF14 |
|---|---|---|---|---|---|---|---|---|---|---|---|---|---|---|---|
| S1 | $I1_1$ | 2 | 2 | 2 | 2 | 2 | 2 | 2 | 2 | 2 | 2 | 2 | 2 | 2 | 2 |
| | I2 | | 8 | 16 | 28 | 36 | 48 | 60 | 72 | 84 | 96 | 108 | 124 | 136 | 152 |
| | $I3_1$ | 2 | | | | | | | | | | | | | |
| | $I4_1$ | | 2 | 2 | 2 | 2 | 2 | 2 | 2 | 2 | 2 | 2 | 2 | 2 | 2 |
| | TOTAL NUMBER OF TIMES OF EMISSION | 4 | 12 | 20 | 32 | 40 | 52 | 64 | 76 | 88 | 100 | 112 | 128 | 140 | 156 |
| | EMISSION LUMINANCE RATIO | 1 | 3 | 5 | 8 | 10 | 13 | 16 | 19 | 22 | 25 | 28 | 32 | 35 | 39 |
| S2 | $I1_2$ | 2 | 2 | 2 | 2 | 2 | 2 | 2 | 2 | 2 | 2 | 2 | 2 | 2 | 2 |
| | I2 | | 8 | 16 | 28 | 36 | 48 | 60 | 72 | 84 | 96 | 108 | 124 | 136 | 154 |
| | $I3_2$ | 2 | 2 | 2 | 2 | 2 | 2 | 2 | 2 | 2 | 2 | 2 | 2 | 2 | |
| | TOTAL NUMBER OF TIMES OF EMISSION | 4 | 12 | 20 | 32 | 40 | 52 | 64 | 76 | 88 | 100 | 112 | 128 | 140 | 156 |
| | EMISSION LUMINANCE RATIO | 1 | 3 | 5 | 8 | 10 | 13 | 16 | 19 | 22 | 25 | 28 | 32 | 35 | 39 |
| S3 | $I1_3$ | 2 | | | | | | | | | | | | | |
| | I2 | | 8 | 16 | 28 | 36 | 48 | 60 | 72 | 84 | 96 | 108 | 124 | 136 | 156 |
| | $I3_3$ | 2 | 2 | 2 | 2 | 2 | 2 | 2 | 2 | 2 | 2 | 2 | 2 | 2 | |
| | $I4_3$ | | 2 | 2 | 2 | 2 | 2 | 2 | 2 | 2 | 2 | 2 | 2 | 2 | |
| | TOTAL NUMBER OF TIMES OF EMISSION | 4 | 12 | 20 | 32 | 40 | 52 | 64 | 76 | 88 | 100 | 112 | 128 | 140 | 156 |
| | EMISSION LUMINANCE RATIO | 1 | 3 | 5 | 8 | 10 | 13 | 16 | 19 | 22 | 25 | 28 | 32 | 35 | 39 |

METHOD FOR DRIVING PLASMA DISPLAY PANEL

BACKGROUND OF THE INVENTION

1. Field of the Invention

This invention relates to a method for driving a plasma display panel.

2. Description of Related Art

Recently, with the trend of enlargement of the screen size of display devices, thin display devices have come to be demanded and various thin display devices have been realized for practical use. The alternating current discharge type plasma display panel is receiving attention as one type of such thin display devices.

In the case of a plasma display panel driven by a subfield method, if the number of subfields, into which the display period of one field is divided, is increased to express more half tones of luminosity, the pulse widths of the drive pulses become short, tending to cause erroneous discharge, making it difficult to obtain a good image quality.

OBJECTS AND SUMMARY OF THE INVENTION

This invention has been made to solve the above problem, and an object of the present invention is to provide a plasma display panel drive method with which a good quality image display can be realized even when the pulse widths of the drive pulses applied to the plasma display panel are made short.

This invention provides a plasma display panel drive method for driving a plasma display panel in which a discharge cell corresponding to a pixel is formed at each intersection of row electrodes corresponding to each of a plurality of display lines and column electrodes aligned to intersect the abovementioned row electrodes. In the plasma display panel drive method, the abovementioned display lines are grouped into a plurality of display line groups, and a reset process, by which reset discharge is made to occur to initialize all of the abovementioned discharge cells to an emitting cell state, is executed only in the first of a plurality of display period divisions that comprise a unit display period for an input video signal. In each of the abovementioned display period divisions, a pixel data writing process is executed by which each of the abovementioned discharge cells is set to either the abovementioned emitting cell state or a non-emitting cell state in accordance with pixel data corresponding to the abovementioned input video signal, and each time the abovementioned data writing process for the abovementioned discharge cells belonging to one display line group among the abovementioned display line groups is completed, an emission sustaining process by which sustained discharge is caused to make the abovementioned emitting cells belonging to the abovementioned one display line group emit light is executed.

BRIEF DESCRIPTION OF THE DRAWINGS

FIG. 7 is a diagram that shows an example of the conversion table in first data conversion circuit 32;

FIG. 8 is a diagram that shows an example of the conversion table in first data conversion circuit 32;

FIG. 13 is a diagram that shows the conversion table and emission drive pattern of second data conversion circuit 34;

FIG. 16 is a diagram that shows the numbers of times of sustained discharge in the respective subfields SF1 to SF14;

FIG. 17 is a diagram that shows another example of the conversion table and emission drive pattern of second data conversion circuit 34;

FIG. 21 is a diagram that shows the numbers of times of sustained discharge to be made to occur in the respective subfields SF1 to SF14 based on the emission drive format shown in FIG. 19;

DETAILED DESCRIPTION OF THE PREFERRED EMBODIMENTS

Before entering into the description of embodiments of the present invention, a prior-art example of a plasma display panel drive method shall be described with reference to the drawings.

Figure 1:
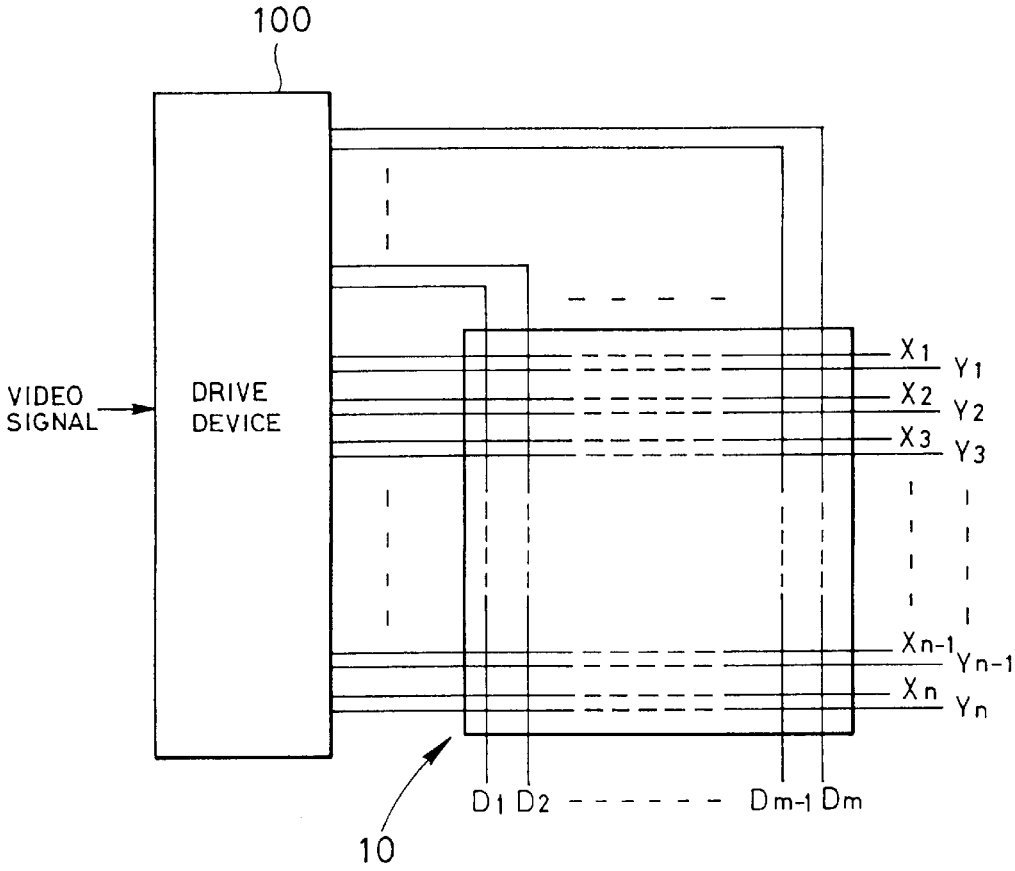
FIG.1 Prior Art
FIG. 1 is a diagram that shows the general arrangement of a plasma display device.

FIG. 1 is a diagram that shows the general arrangement of a plasma display device, comprised of a plasma display panel and a drive device, which drives the plasma display panel.

In FIG. 1, the plasma display panel, PDP 10, has, as data electrodes, m column electrodes $D_1$ to $D_m$ as well as n row electrodes $X_1$ to $X_n$ and n row electrodes $Y_1$ to $Y_n$, which are aligned to intersect with each of the column electrodes. With the row electrodes $X_1$ to $X_n$ and row electrodes $Y_1$ to $Y_n$, one pair of row electrodes X and Y serves a display line corresponding to one row of the PDP. These column electrodes D and row electrodes X and Y are respectively formed on each of two glass substrates disposed so as to oppose each other across a discharge space, and a discharge cell, corresponding to one pixel, is formed at the intersection of each row electrode pair and column electrode.

Here, each discharge cell makes use of a discharge phenomenon to emit light and has only the two states of "emitting" and "non-emitting." That is, a discharge cell can only express the luminance of the two gradations of lowest luminance (non-emitting condition) and highest luminance (emitting condition).

Drive device 100 thus carries out gradation drive of PDP 10 using the subfield method to realize luminance displays of half-tones corresponding to the input video signals.

Figure 2:
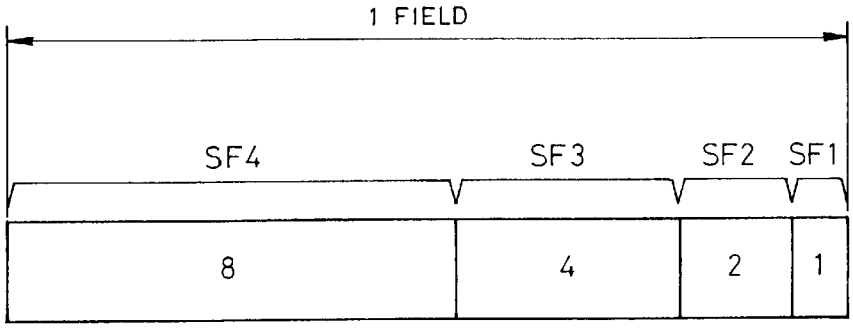
FIG. 2 Prior Art
FIG. 2 is a diagram that shows an example of an emission drive format.

In the subfield method, the input video signals are for example converted into four-bit pixel data corresponding to the respective pixels and a single field is divided into four subfields SF1 to SF4 as shown in FIG. 2 in correspondence with each bit digit of the four bits.

Figure 3:
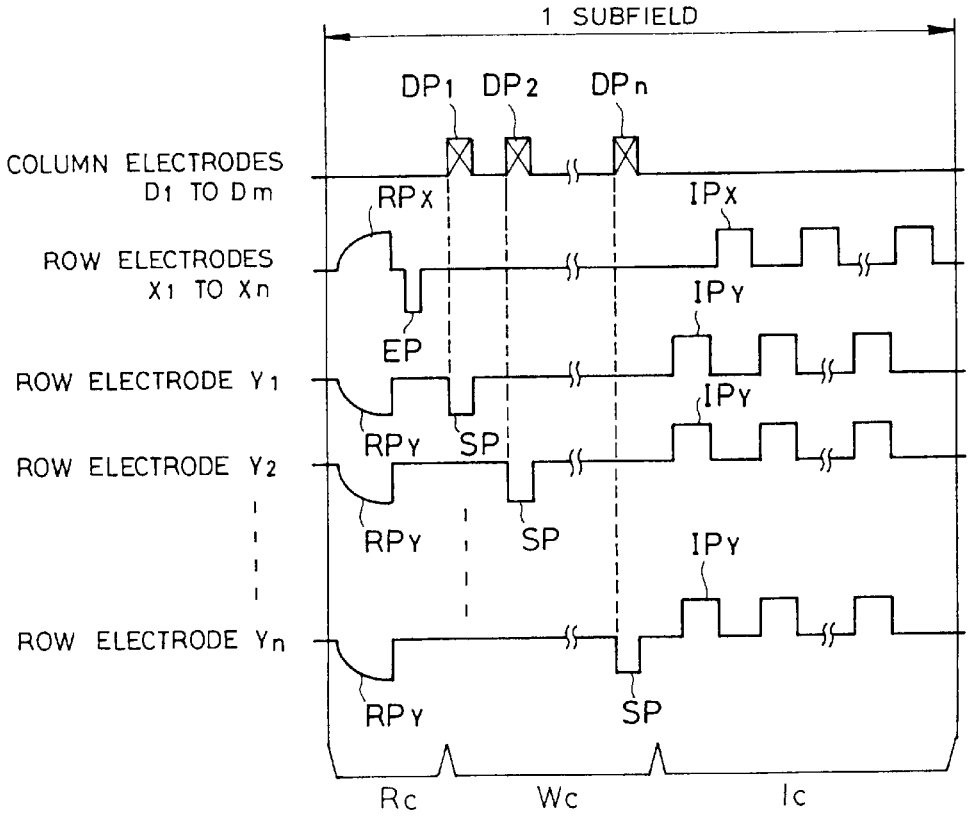
FIG. 3 Prior Art
FIG. 3 is a diagram that shows the timings of application of the drive pulses to be applied to the column electrodes and row electrodes of a PDP 10 in one subfield.

FIG. 3 is a diagram that shows the timings of application of the various drive pulses that drive device 100 applies to the row electrode pairs and column electrodes in a single subfield.

As shown in FIG. 3, drive device 100 first applies a reset pulse $RP_X$ of a positive polarity to row electrodes $X_1$ to $X_n$ and a reset pulse $RP_Y$, of a negative polarity to row electrodes $Y_1$ to $Y_n$. In response to the application of these reset pulses $RP_X$ and $RP_Y$, all of the discharge cells of PDP 10 undergo reset discharge and a wall charge of predetermined amount is formed uniformly in each discharge cell. Immediately thereafter, drive device 100 applies an erase pulse EP to all row electrodes $X_1$ to $X_n$ of PDP 10 at once. Erasure discharge is thereby caused in all discharge cells and the above wall charge disappears (general reset process Rc). That is, by this general reset process Rc, all discharge cells of PDP 10 are initialized to the "non-emitting cell" state.

Next, drive device 100 successively applies pixel data pulse sets $DP_1$ to $DP_n$, each of which is for one row and corresponds to the input video signals, to the column electrodes $D_{1-m}$ and generates and successively applies scan pulses SP to row electrodes $Y_1$ to $Y_n$ at the timing of application of each data pulse set DP (pixel data writing process Wc). In this process, discharge (selective writing discharge) occurs and a wall charge is formed only in the discharge cells at intersections of "rows" to which scan pulses SP were applied and the "columns" to which the high-voltage pixel data pulses were applied. A discharge cell, that had been initialized to the "non-emitting cell" state in the above-described general reset process Rc thereby undergoes the transition to an "emitting cell." Meanwhile, the abovementioned selective writing discharge does not occur in a discharge cell, to which a scan pulse SP was applied but to which a low-voltage pixel data pulse was applied as well, and such a discharge cell is held in the state initialized by the above-described general reset process Rc, in other words, in the "non-emitting cell" state.

Next, as shown in FIG. 3, drive device 100 applies sustaining pulses $IP_X$ repeatedly to row electrodes $X_1$ to $X_n$ and also applies sustaining pulses $IP_Y$ repeatedly to row electrodes $Y_1$ to $Y_n$ at timings that are shifted with respect to the timings of application of sustaining pulse $IP_X$ (emission sustaining process Ic). The number of times the sustaining pulses $IP_X$ and $IP_Y$ are applied are set in accordance to the weighing of the respective subfields, such as shown in FIG. 2. Here, sustained discharge occurs each time the sustaining pulses $IP_X$ and $IP_Y$ are applied only in discharge cells in which a wall charge exists, in other words, only in "emitting cells." That is, only discharge cells that have been set to the "emitting cell" state in the above-described pixel data writing process Wc emit light repeatedly in accompaniment with the sustained discharge for the number of times corresponding to the weighing of the subfields, such as shown in FIG. 2, and is maintained in this light emitting state.

Drive device 100 performs the above-described operations in each of the subfields. Here, halftone luminance, corresponding to the video signals, is expressed by the total (within one field) of the numbers of times of the abovementioned sustained discharged caused in each subfield.

The number of luminance halftones that can be expressed by the above-described subfield method increases as the number of subfield divisions is increased. However, since the display period of a single field is set in advance, the pulse widths of the various drive pulses, such as those shown in FIG. 3, must be shortened in order to increase the number of subfields.

However, if the pulse widths of the drive pulses are made short, erroneous discharge will tend to occur, thus inhibiting the obtaining of good display quality as has been mentioned above.

Embodiments of this invention shall now be described with reference to the drawings.

Figure 4:
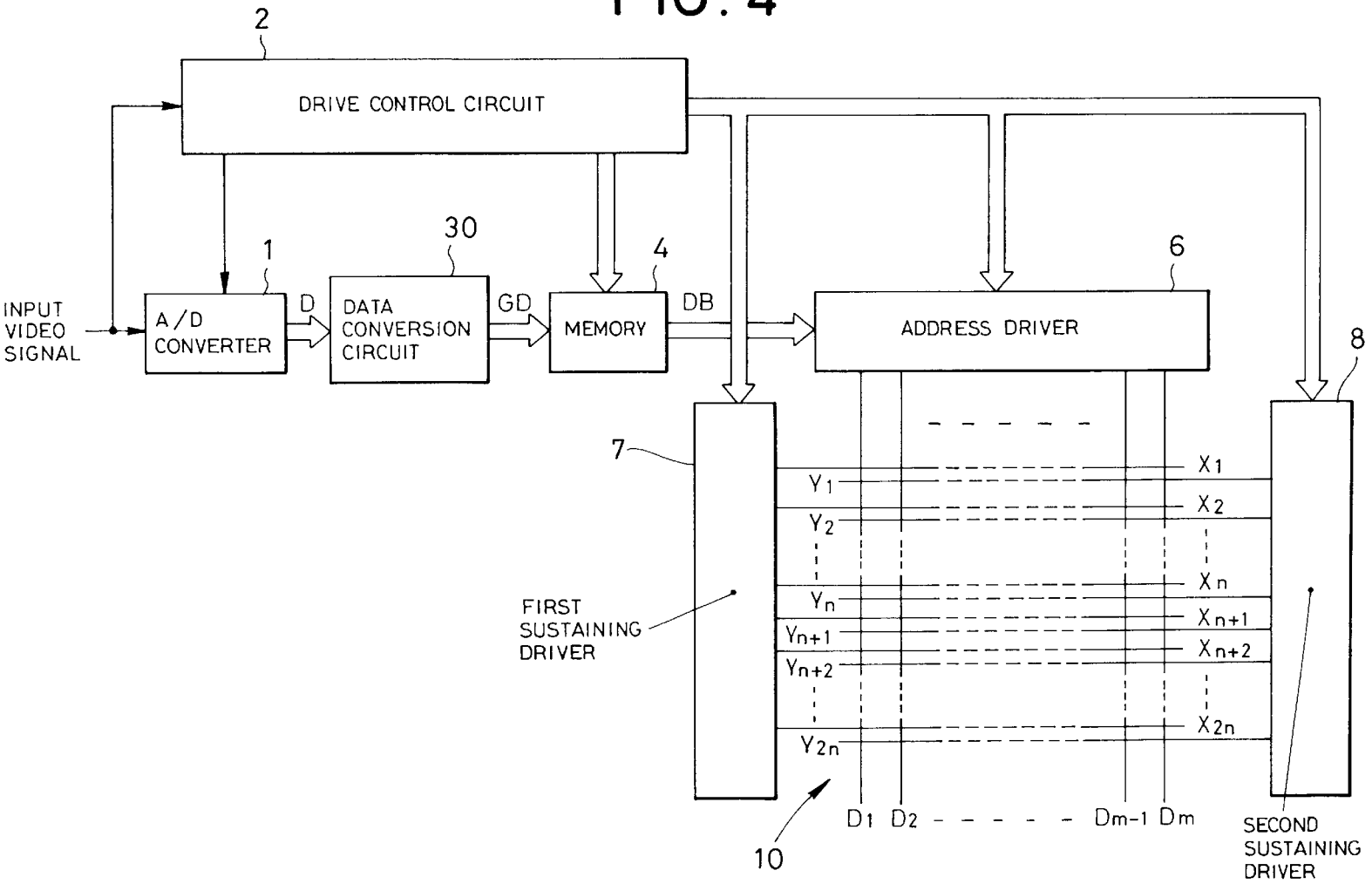
FIG. 4 is a diagram that shows the general arrangement of a plasma display device that drives a plasma display panel in accordance with a drive method of the present invention.

FIG. 4 is a diagram that shows the general arrangement of a plasma display device, which drives a plasma display panel based on a drive method of this invention.

As shown in FIG. 4, this plasma display device is comprised of PDP 10, which is the plasma display panel, and a drive unit, which in turn is comprised of an A/D converter 1, drive control circuit 2, data conversion circuit 30, memory 4, address driver 6, first sustaining driver 7, and second sustaining driver 8.

As address electrodes, PDP 10 is equipped with m column electrodes $D_1$ to $D_m$ as well as 2n row electrodes $X_1$ to $X_{2n}$ and 2n row electrodes $Y_1$ to $Y_{2n}$, which are aligned so as to intersect with each of the column electrodes. Here a row electrode corresponding to one display line of PDP 10 is formed by a pair of row electrode X and row electrode Y. Column electrodes D and row electrodes X and Y are covered with respect to the discharge space by dielectric layers, and a discharge cell, corresponding to 1 pixel, is formed at the intersection of each row electrode pair and column electrode.

A/D converter 1 samples the input analog video signals, which are input in accordance with a clock signal supplied from drive control circuit 2, converts the video signals for example into 8-bit pixel data D, corresponding to one pixel, and supplies the data to data conversion circuit 30.

Figure 5:
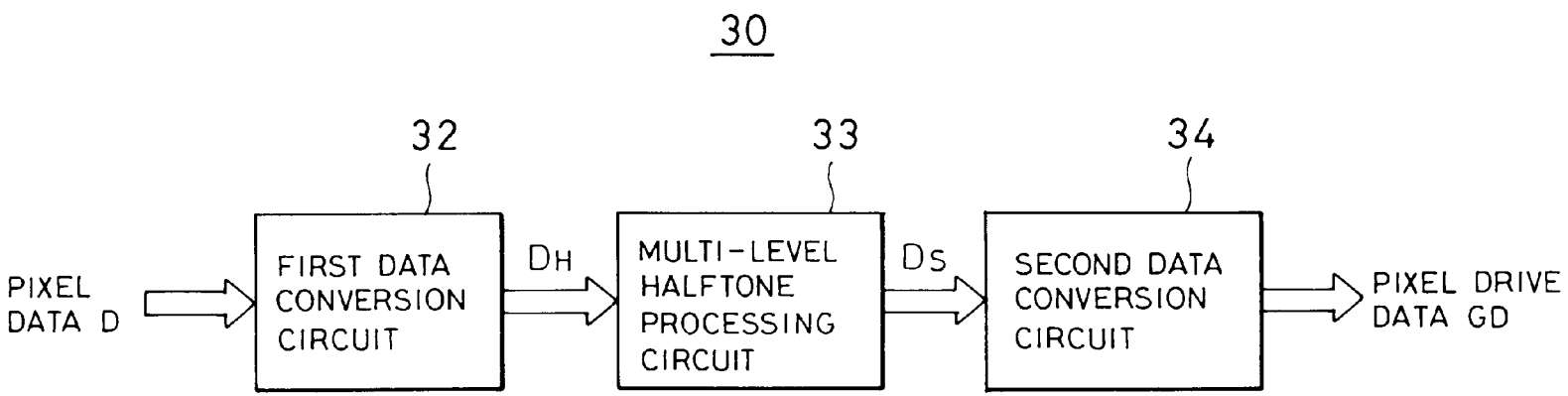
FIG. 5 is a diagram that shows the internal arrangement of a data conversion circuit 30.

FIG. 5 is a diagram that shows the internal arrangement of this data conversion circuit 30.

As shown in FIG. 5, data conversion circuit 30 is comprised of a first data conversion circuit 32, a multi-level halftone processing circuit 33, and a second data conversion circuit 34.

Figure 6:
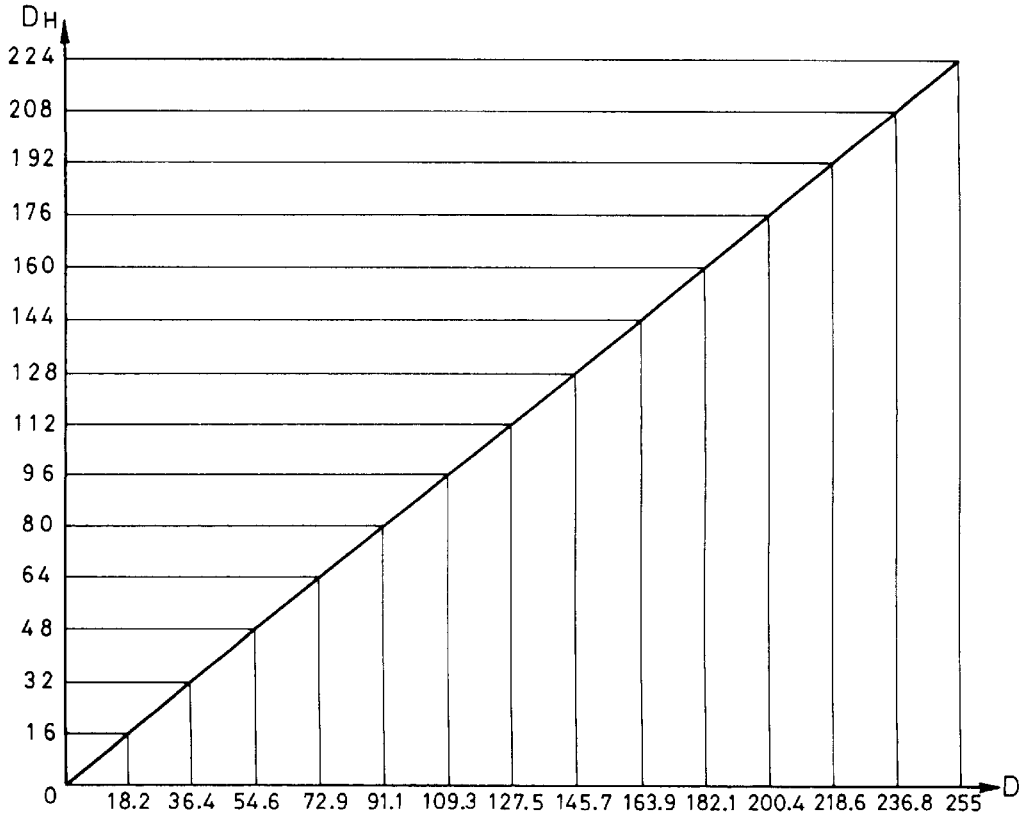
FIG. 6 is a diagram that shows the conversion characteristics of first data conversion circuit 32.

First data conversion circuit 32 converts the 8-bit (0 to 255) pixel data D, supplied from A/D converter 1, into 8-bit (0 to 224) converted pixel data $D_H$ in accordance with conversion characteristics such as those in FIG. 6 and supplies the converted pixel data DH to multi-level halftone processing circuit 33. That is, first data conversion circuit 32 converts pixel data D into converted pixel data $D_H$ for example on the basis of the data conversion tables shown in FIGS. 7 and 8.

By thus providing a first data conversion circuit 32 and performing data conversion in accordance with the number of display halftones and the number of compressed bits based on multi-level halftone processing, at the stage prior to the multi-level halftone processing circuit 33 to be described below, the generation of parts that are flat in display characteristics (that is, the generation of halftone distortion), which occurs in the case where the luminance saturation and display halftones resulting from the multi-level halftone process does not lie within bit boundaries, is prevented.

Figure 9:
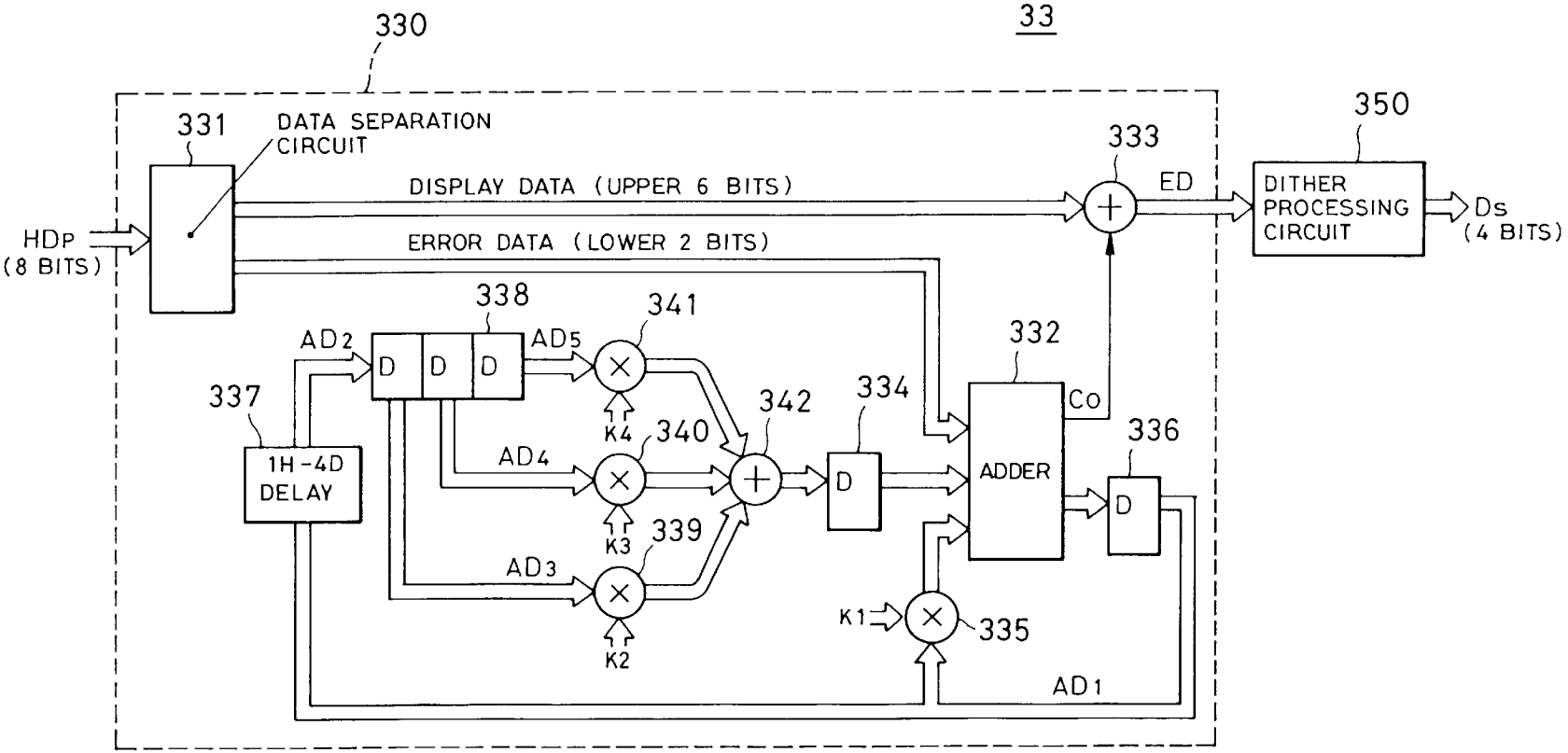
FIG. 9 is a diagram that shows the internal arrangement of a multi-level halftone processing circuit 33.

FIG. 9 is a diagram that shows the internal arrangement of multi-level halftone processing circuit 33.

As shown in FIG. 9, this multi-level halftone processing circuit 33 is comprised of an error diffusion processing circuit 330 and a dither processing circuit 350.

First, the data separation circuit 331 in error diffusion processing circuit 330 separates the upper six bits of the 8-bit converted pixel data $D_H$, supplied from the abovementioned first data conversion circuit 32, as the display data and the lower two bits of converted pixel data $D_H$ as error data. Adder 332 then supplies to delay circuit 336, the sum value resulting from the addition of the error data, in other words, the lower two bits of first converted pixel data $D_H$, the delay output from delay circuit 334, and the multiplication output of factor multiplier 335. Delay circuit 336 delays the sum value supplied from adder 332 by a delay time D of just the same duration as the clock period of the pixel data, and supplies the sum value as the delayed addition signal $AD_1$ respectively to the abovementioned factor multiplier 335 and delay circuit 337. Factor multiplier 335 supplies to the abovementioned adder 332, the multiplication result obtained by multiplication of the abovementioned delayed addition signal $AD_1$ by a predetermined factor $K_1$ (for example, "7/16"). Delay circuit 337 delays the abovementioned delayed addition signal $AD_1$ further by the duration, (one horizontal scan period—the abovementioned delay time D×4), and supplies this signal as delayed addition signal $AD_2$ to delay circuit 338. Delay circuit 338 delays the delayed addition signal $AD_2$ further by the abovementioned delay time D and then supplies this signal as delayed addition signal $AD_3$ to factor multiplier 339. Delay circuit 338 also delays the delayed addition signal $AD_2$ further by the abovementioned delay time D×2 and then supplies this signal as delayed addition signal $AD_4$ to factor multiplier 340. Delay circuit 338 furthermore delays the delayed addition signal $AD_2$ further by the abovementioned delay time D×3 and then supplies this signal as delayed addition signal $AD_5$ to factor multiplier 341. Factor multiplier 339 supplies the multiplication result of multiplying the abovementioned delayed addition signal $AD_3$ by a predetermined f actor $K_2$ (for example, "3/16") to adder 342. Factor multiplier 340 supplies the multiplication result of multiplying the abovementioned delayed addition signal $AD_4$ by a predetermined factor $K_3$ (for example, "5/16") to adder 342. Factor multiplier 341 supplies the multiplication result of multiplying the abovementioned delayed addition signal $AD_5$ by a predetermined factor $K_4$ (for example, "1/16") to adder 342. Adder 342 supplies the addition signal, obtained by adding the multiplication results supplied from each of the abovementioned factor multipliers 339, 340, and 341, to the abovementioned delay circuit 334. Delay circuit 334 delays this addition signal by just the abovementioned delay time D and supplies this signal to the abovementioned adder 332. Adder 332 adds together the abovementioned error data (lower 2 bits of the first converted pixel data $D_H$), the delayed output from delay circuit 334, and the multiplication output from factor multiplier 335, and generates a carry-out signal $C_0$ of logic level "0" if the addition does not result in a carry or a carry-out signal $C_0$ of logic level "1" if the addition results in a carry, and supplies this carry-out signal $C_0$ to adder 333. Adder 333 outputs the sum of the abovementioned display data (the upper 6 bits of the first converted pixel data $D_H$) and the abovementioned carry-out signal $C_0$ as the 6-bit error diffusion processed pixel data ED.

The operation of error diffusion processing circuit 330 of the above-described arrangement shall now be described.

Figure 10:
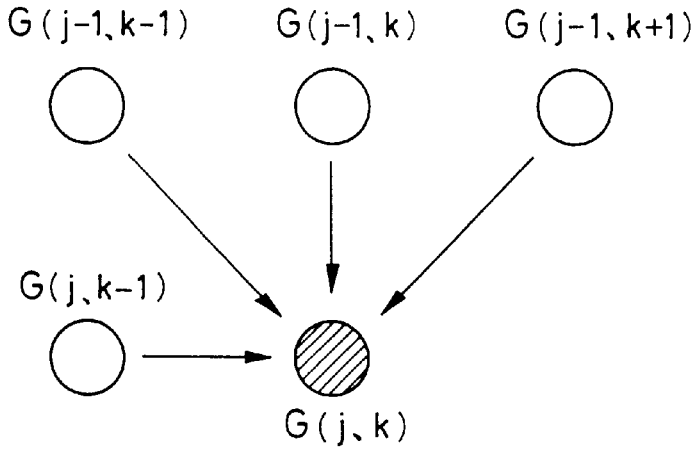
FIG. 10 is a diagram for explaining the operation of an error diffusion processing circuit 330.

For example, in determining the error diffusion processed pixel data ED corresponding to a pixel G(j, k) of PDP 10 such as that shown in FIG. 10, weighed addition using predetermined factor values $K_1$ to $K_4$, such as those mentioned above, is performed on the error data corresponding respectively to the pixel G(j, k−1) to the direct left of pixel G(j, k), the pixel G(j−1, k−1) to the upper left, the pixel G(j−1, k) directly above, and the pixel G(j−1, k+1) to the upper right, in other words,

- the error data corresponding to pixel G(j, k−1): delayed addition signal $AD_1$,
- the error data corresponding to pixel G(j−1, k+1): delayed addition signal $AD_3$,
- the error data corresponding to pixel G(j−1, k): delayed addition signal $AD_4$, and the error data corresponding to pixel G(j−1, k−1): delayed addition signal $AD_5$.

Next, the lower 2 bits of the first converted pixel data $D_H$, in other words, the error data corresponding to pixel G(j, k) is added to the above addition result, and the 1-bit carry-out signal $C_0$ obtained from this addition is added to the upper 6 bits of the first converted pixel data $D_H$, in other words, the display data corresponding to pixel G(j, k), to obtain the error diffusion processed pixel data ED.

That is, error diffusion processing circuit 330 handles the upper 6 bits of first converted pixel data $D_H$ as the display data and the remaining lower bits as error data and makes the result of weighed addition of the respective error data in the surrounding pixels {G(j, k−1), G(j−1, k+1), G(j−1, k), and G(j−1, k−1)} be reflected in the abovementioned display data. By this operation, the luminance component corresponding to the lower bits in the original pixel {G(j, k)} is expressed artificially by the abovementioned surrounding pixels, thus enabling luminous halftone expression equivalent to 8-bit pixel data using display data that are lower in the number of bits than 8 bits, in other words, using 6 bits of display data.

When this error diffusion factor value is added uniformly to each pixel, there may arise cases where the noise due to the error diffusion pattern becomes visibly recognizable, thereby damaging the picture quality. Thus the error diffusion factors $K_1$ to $K_4$, which are to be allocated respectively to four pixels, may be changed in each single field (frame) as in the case of the dither factor to be described below.

Dither processing circuit 350 applies a dithering process to the error diffusion processed pixel data ED, supplied from error diffusion processing circuit 330, to produce multi-level halftone processed pixel data $D_S$, which though maintaining luminous halftone levels equivalent to the 6-bit error diffusion processed pixel data ED, are reduced further in bit number to 4 bits. In this dithering process, a single halftone display level is expressed by a plurality of adjacent pixels. For example, to perform halftone display equivalent to 8 bits using the upper 6-bit pixel data of 8-bit pixel data, the four pixel data that are adjacent at the left, right, upper, and lower sides are used as one set, and four dither factors a to d, which are mutually different in value, are allocated and added respectively to the pixel data corresponding to the respective pixels of this set. By this dithering process, combinations of four different halftone display levels are generated from four pixels. Thus for example, even if the bit number of the pixel data is 6 bits, the luminance gradation that can be expressed will be four times that, in other words, a halftone display equivalent to 8 bits will be possible.

However, if a dither pattern based on dither factors a to d is added uniformly to each pixel, cases may arise where the noise due to this dither pattern will be visibly recognizable, thereby damaging the picture quality.

Thus with dither processing circuit 350, the abovementioned dither factors a to d, which are to be allocated respectively to the four pixels, are changed in each single field.

Figure 11:
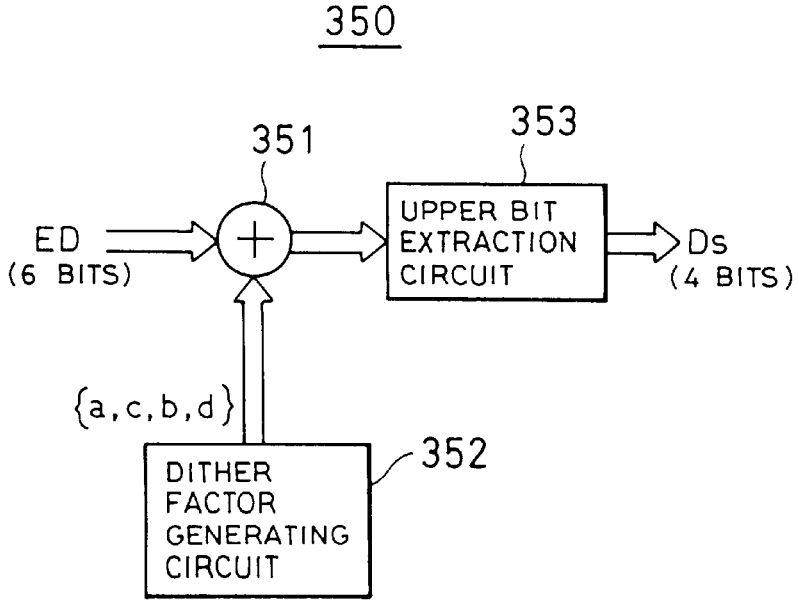
FIG. 11 is a diagram that shows the internal arrangement of a dither processing circuit 350.

FIG. 11 is a diagram that shows the internal arrangement of this dither processing circuit 350.

In FIG. 11, dither factor generating circuit 352 generates four dither factors, a, b, c, and d, for every four mutually adjacent pixels and supplies these factors successively to adder 351.

Figure 12:
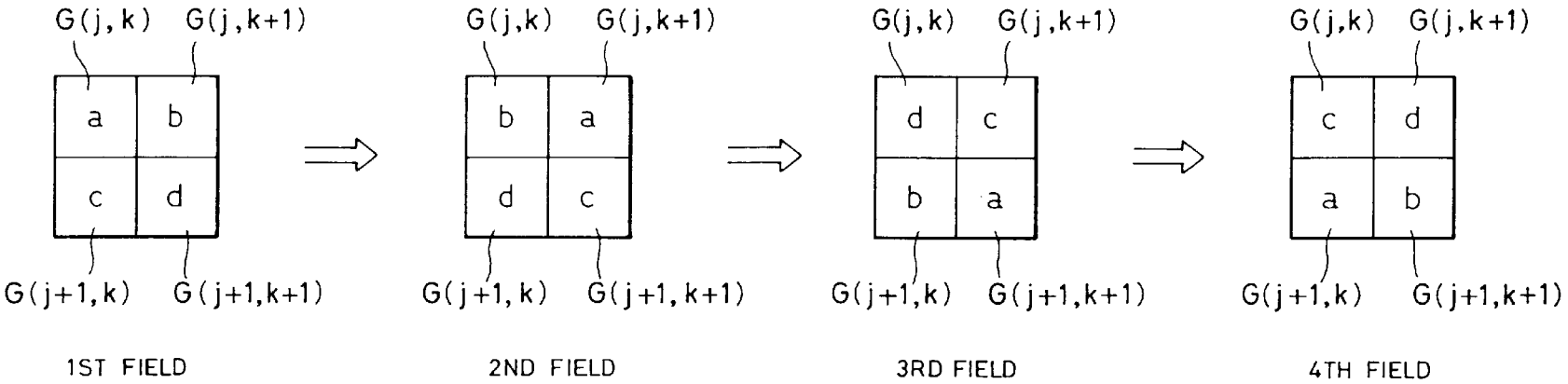
FIG. 12 is a diagram for explaining the operation of dither processing circuit 350.

As shown for example in FIG. 12, these dither factors a to d are respectively allocated to four mutually adjacent pixels, i.e., pixels G(j, k) and pixel G(j, k+1), which correspond to the jth row, and pixel G(j+1, k) and pixel G(j+1, k+1), which correspond to the (j+1)th row. Dither factor generating circuit 352 changes the abovementioned dither factors a to d, to be allocated respectively to these four pixels, in each single field as shown in FIG. 12.

That is, dither factor generating circuit 352 generates dither factors a to d in the following manner in the initial first field, Pixel G(j, k): Dither factor a Pixel G(j, k+1): Dither factor b Pixel G(j+1, k): Dither factor c Pixel G(j+1, k+1): Dither factor d in the following manner in the subsequent second field, Pixel G(j, k): Dither factor b Pixel G(j, k+1): Dither factor a Pixel G(j+1, k): Dither factor d Pixel G(j+1, k+1): Dither factor c in the following manner in the subsequent third field, Pixel G(j, k): Dither factor d Pixel G(j, k+1): Dither factor c Pixel G(j+1, k): Dither factor b Pixel G(j+1, k+1): Dither factor a and in the following manner in the subsequent fourth field.

Pixel G(j, k): Dither factor c

Pixel G(j, k+1): Dither factor d

Pixel G(j+1, k): Dither factor a

Pixel G(j+1, k+1): Dither factor b

Dither factor generating circuit 352 thus repeatedly generates dither factors a to d in a cyclical manner as shown above and supplies these factors to adder 351. Dither factor generating circuit 352 repeatedly executes the operations for the first field to the fourth field as described above. That is, when the dither factor generating operation for the fourth field has ended, dither factor generating circuit 352 returns to the above-described operation for the first field and repeats the above-described operations. Adder 351 adds the dither factors a to d, allocated to each field as described above, respectively to the error diffusion processed pixel data ED corresponding respectively to the abovementioned pixel G(j, k), pixel G(j, k+1), pixel G(j+1, k), and pixel G(j+1, k+1), which are supplied from the above-described error diffusion processing circuit 330, and supplies the dither added pixel data obtained in this process to an upper bit extraction circuit 353.

For example, in the first field shown in FIG. 12, the error diffusion processed pixel data ED corresponding to pixel G(j, k)+dither factor a, the error diffusion processed pixel data ED corresponding to pixel G(j, k+1)+dither factor b, the error diffusion processed pixel data ED corresponding to pixel G(j+1, k)+dither factor c, and the error diffusion processed pixel data ED corresponding to pixel G(j+1, k+1)+dither factor d are respectively and successively supplied to upper bit extraction circuit 353 as dither added pixel data. The upper bit extraction circuit 353 extracts up to the upper four bits of the dither added pixel data and outputs this as multi-level halftoned pixel data $D_S$.

The abovementioned dither factors a to d, to be allocated respectively to four pixels, are thus changed in each single field to determine the 4-bit multi-level halftoned pixel data $D_S$, which are gradated visibly in multiple levels while being reduced in the visible noise due to the dither pattern, and these data are then supplied to second data conversion circuit 34.

Second data conversion circuit 34 converts the 4-bit multi-level halftoned pixel data $D_S$ in accordance with a conversion table, such as that shown in FIG. 13, to display drive data GD, comprised of first to fourteenth bits, and supplies the display drive data GD to memory 4. These first to fourteenth bits correspond respectively to the subfields SF1 to SF14 to be described below.

As has been described above, the data conversion circuit 30, comprised of the above-described first data conversion circuit 32, multi-level halftone processing circuit 33, and second data conversion circuit 34, converts the pixel data D, with which 256 halftones can be expressed with 8 bits, to one of the 15 types of display drive data GD, such as shown in FIG. 13, and supplies the converted data to memory 4.

Memory 4 successively writes and stores the abovementioned display drive data GD in accordance with the write signal supplied from the abovementioned drive control circuit 2. When the writing of display drive data $GD_{11-nm}$ for one screen (n rows and m columns) by this writing operation is completed, memory 4 reads out the same bit digits of display drive data $GD_{11-nm}$ for one row at a time in accordance with the read signal supplied from drive control circuit 2 and supplies the data to address driver 6. That is, memory 4 handles the display drive data $GD_{11-nm}$, each of which is comprised of 14 bits, according to each bit digit as drive data bits $DB1_{11-nm}$ to $DB14_{11-nm}$ as follows;

$DB1_{11-nm}$: 1st bit of display drive data $GD_{11-nm}$ $DB2_{11-nm}$: 2nd bit of display drive data $GD_{11-nm}$ $DB3_{11-nm}$: 3rd bit of display drive data $GD_{11-nm}$ $DB4_{11-nm}$: 4th bit of display drive data $GD_{11-nm}$ $DB5_{11-nm}$: 5th bit of display drive data $GD_{11-nm}$ $DB6_{11-nm}$: 6th bit of display drive data $GD_{11-nm}$ $DB7_{11-nm}$: 7th bit of display drive data $GD_{11-nm}$ $DB8_{11-nm}$: 8th bit of display drive data $GD_{11-nm}$ $DB9_{11-nm}$: 9th bit of display drive data $GD_{11-nm}$ $DB10_{11-nm}$: 10th bit of display drive data $GD_{11-nm}$
$DB11_{11-nm}$: 11th bit of display drive data $GD_{11-nm}$
$DB12_{11-nm}$: 12th bit of display drive data $GD_{11-nm}$
$DB13_{11-nm}$: 13th bit of display drive data $GD_{11-nm}$
$DB14_{11-nm}$: 14th bit of display drive data $GD_{11-nm}$ and reads each of $DB1_{11-nm}$, $DB2_{11-nm}$, ¥¥¥, $DB14_{11-nm}$ for one row at a time in accordance with the read signal from drive control circuit 2 and supplies the data to address driver 6.

Drive control circuit 2 generates the clock signal for the abovementioned A/D converter 1 and the write and read signals for memory 4 in synchronization with the horizontal and vertical synchronization signals in the abovementioned input video signal.

Figure 14:
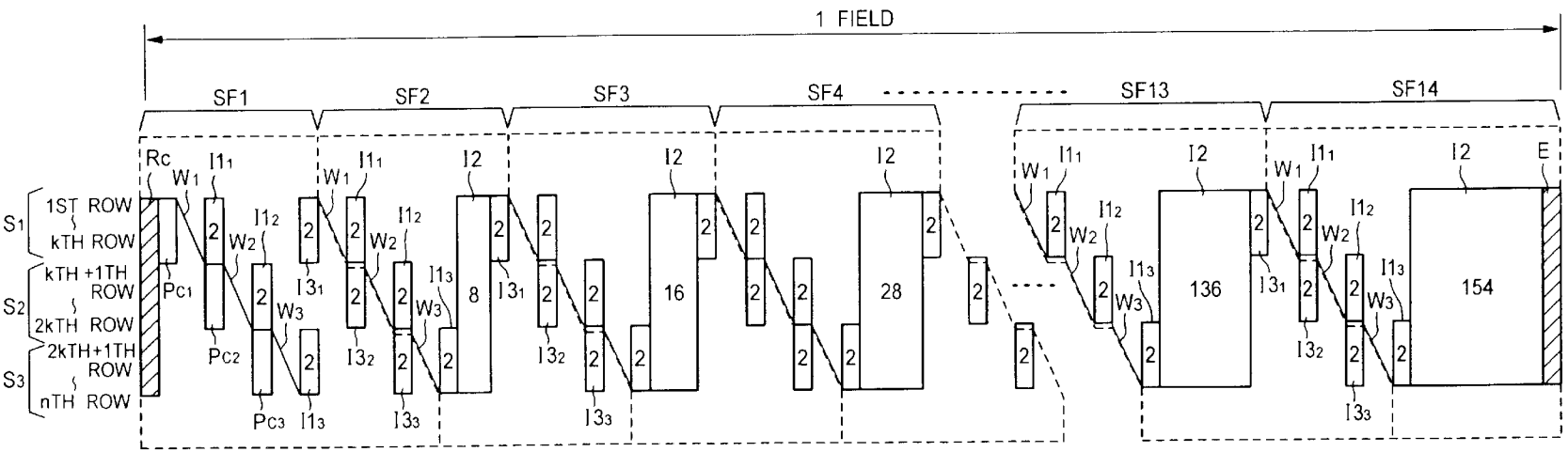
FIG. 14 is a diagram that shows an example of an emission drive format based on a drive method of this invention.

Furthermore, drive control circuit 2 generates the various timing signals for driving and controlling each of address driver 6, first sustaining driver 7, and second sustaining driver 8 based on an emission drive format, such as that shown in FIG. 14.

Figure 15:
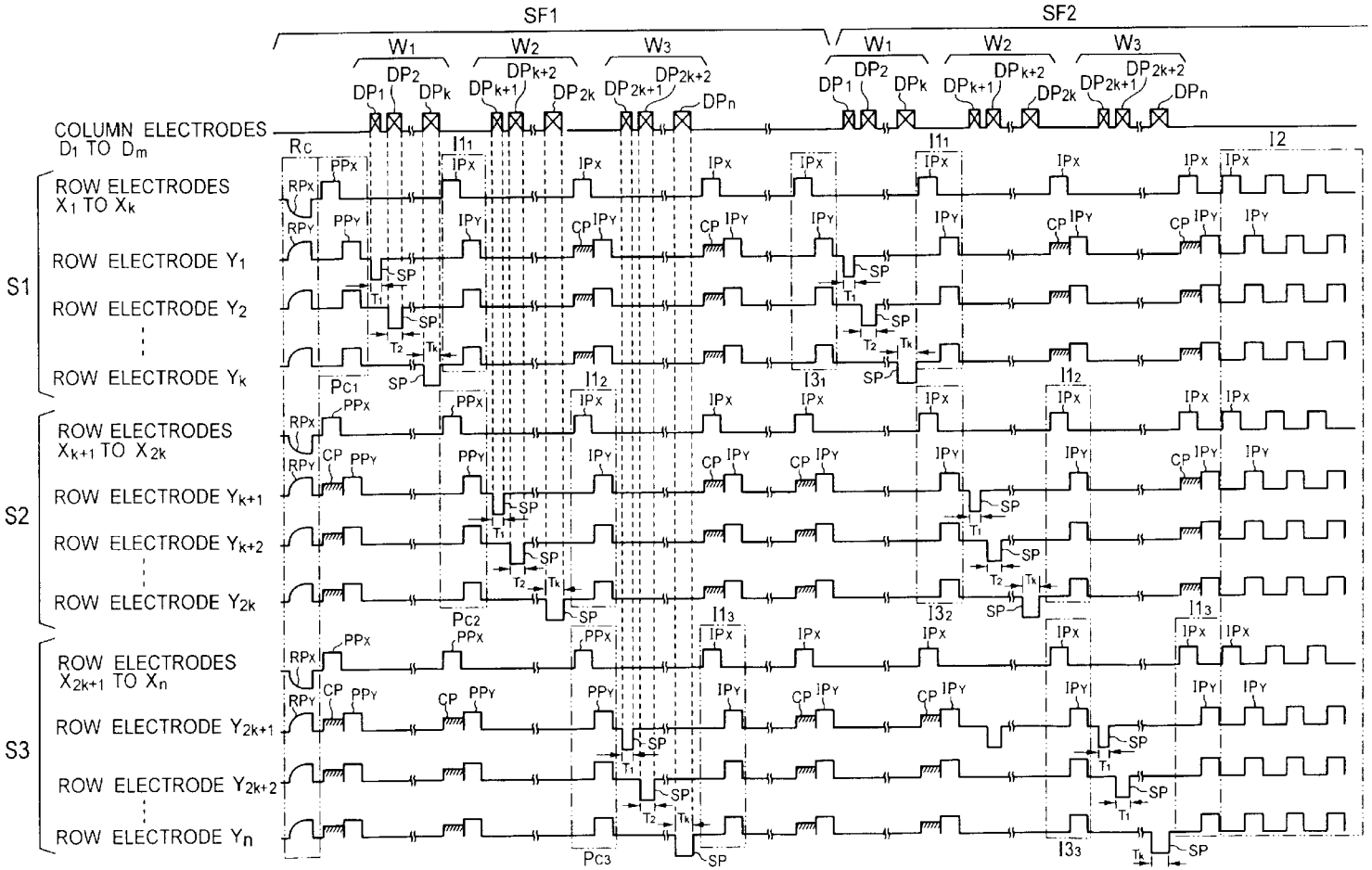
FIG. 15 is a diagram that shows part of the timings of application of the various drive pulses to be applied to the column electrodes and row electrodes of PDP 10 in accordance with the emission drive format shown in FIG. 14.

The emission drive format shown in FIG. 14 divides the display period of one field (hereinafter, this shall refer inclusively refer to "one frame" as well) into the 14 subfields SF1 to SF14 to perform gradation drive of PDP 10. FIG. 15 is a diagram that shows an example of the timings at which the various drive pulses are applied to the column electrodes $D_1$ to $D_m$ and row electrodes $X_1$ to $X_n$ and $Y_1$ to $Y_n$ of PDP 10 by the abovementioned address driver 6, first sustaining driver 7, and second sustaining driver 8 in accordance with timing signals supplied from drive control circuit 2. In FIG. 15 are excerpted and shown the timings of application of drive pulses in SF1 and SF2, among the subfields SF1 to SF14 shown in FIG. 14.

In FIG. 15, second sustaining driver 8 first generates a reset pulse $RP_X$ of a negative polarity as shown in FIG. 15 in the subfield SF1 and applies this pulse simultaneously to all row electrodes $X_1$ to $X_n$ of PDP 10. At the same time, first sustaining driver 7 generates a reset pulse $RP_Y$ of a positive polarity as shown in FIG. 15 and applies this pulse simultaneously to all row electrodes $Y_1$ to $Y_n$ of PDP 10. In response to the application of these reset pulses $RP_X$ and $RP_Y$, all discharge cells in PDP 10 undergo reset discharge and a predetermined wall charge is formed uniformly in the respective discharge cells. All discharge cells are thereby set once to be "emitting cells."

After the completion of the above-described general reset process Rc, second sustaining driver 8 simultaneously applies a priming pulse $PP_X$ of a positive polarity as shown in FIG. 15 to all row electrodes $X_1$ to $X_n$ of PDP 10. At the same time as this application of priming pulse $PP_X$, first sustaining driver 7 simultaneously applies a low level cancel pulse CP of a positive polarity as shown in FIG. 15 to the row electrodes $Y_{k+1}$ to $Y_n$ belonging to the row electrode set (shall be referred to hereinafter as "row electrode set S2") that serves the (k+1)th to 2kth row of PDP 10 and the row electrode set (shall be referred to hereinafter as "row electrode set S3") that serves the (2k+1)th to nth rows of PDP 10. After the application of cancel pulse CP, first sustaining driver 7 simultaneously applies a priming pulse $PP_Y$ of a positive polarity as shown in FIG. 15 to all row electrodes $Y_1$ to $Y_n$ of PDP 10 (priming process $Pc_1$). By the application of these priming pulses $PP_X$ and $PP_Y$, priming discharge is caused twice across only the row electrodes Y and X belonging to the row electrode set (shall be referred to hereinafter as "row electrode set S1") for the 1st row to kth row of PDP 10, and charged particles are formed in the discharge spaces of the respective discharge cells belonging to this row electrode set S1. In the respective discharge cells belonging to the (k+1)th to nth rows of PDP 10 to which the abovementioned cancel pulse CP was applied, discharge does not occur even if priming pulses $PP_X$ and $PP_Y$ are applied.

After the execution of the priming process $Pc_1$, address driver 6 selects, from among the display drive data bits $DB1_{11-nm}$ to $DB14_{11-nm}$ supplied from the abovementioned memory 4, the display drive data bits $DB1_{11-nm}$ that correspond to subfield SF1 and furthermore extracts from among the selected data bits, those corresponding to the 1st to kth rows, in other words, $DB1_{11-km}$. Address driver 6 generates pixel data pulses of a voltage corresponding to the respective logic levels of $DB1_{11-km}$, and successively applies these as pixel data pulse sets $DP_1$ to $DP_k$, each in correspondence to one row, to column electrodes $D_{1-m}$. That is, first the data bits among the abovementioned $DB1_{11-km}$ that correspond to the 1st row, in other words, $DB1_{11-1m}$ are extracted and the pixel data pulse set $DP_1$, comprised of m pixel data pulses corresponding to the respective logic levels of $DB1_{11-1m}$, is generated and applied to column electrodes $D_{1-m}$. Then the $DB1_{21-2m}$, which correspond to the 2nd row, are extracted from $DB1_{11-km}$, and the pixel data pulse set $DP_2$, comprised of m pixel data pulses corresponding to the respective logic levels of $DB1_{21-2m}$, is generated and applied to column electrodes $D_{1-m}$. Thereafter in the abovementioned pixel data writing process $W_1$, address driver 6 successively applies the pixel data pulse sets $DP_3$ to $DP_k$, respectively corresponding to the 3rd to kth rows of PDP 10 and each being applied in correspondence to one row, to column electrodes $D_{1-m}$ in a likewise manner. Here, address driver 6 applies a high-voltage pixel data pulse if for example the logic level of the display drive data bit DB is "1" and applies a low-voltage (0 volt) pixel data pulse if the logic level is "0." Second sustaining driver 8 generates negative-polarity scan pulses SP, of the same pulse widths as the abovementioned pixel data pulses DP, in synchronization with each of the above pixel data pulse sets $DP_1$ to $DP_k$ and applies these scan pulses SP successively to the row electrodes $Y_1$ to $Y_k$ belonging to the abovementioned row electrode set S1 (pixel data writing process $W_1$). In this process, discharge (selective erasure discharge) occurs only in discharge cells to which scan pulses SP have been applied and which at the same time belong to the abovementioned row electrode set S1 to which the high-voltage pixel data pulses have been applied, and the residual wall charge in such discharge cells disappears. That is, discharge cells, which have been initialized in the general reset process Rc to the "emitting cell" state, undergo the transition to "non-emitting cells." On the other hand, since the abovementioned selective erasure discharge is not caused in discharge cells to which scan pulses SP have been applied but to which the low-voltage pixel data pulses have been applied as well, these are kept in the condition initialized by the abovementioned general reset process Rc, in other words, in the "emitting cell" state.

As shown by $T_1$ to $T_k$ of FIG. 15, each of the abovementioned pixel data pulses DP and scan pulses SP, which are applied in the above-described pixel data writing process $W_1$, are made short in pulse width immediately after the above-described priming process $Pc_1$ and are then made wider in pulse width with the lapse of time. This is done since immediately after the priming process $Pc_1$, charged particles are formed in the discharge spaces of the respective discharge cells by the priming discharge caused by the priming process $Pc_1$ and selective erasure discharge can thus be caused satisfactorily even if the scan pulses and the pixel data pulses are made short in pulse width.

After the execution of the above-described pixel data writing process $W_1$, second sustaining driver 8 simultaneously applies a sustaining pulse $IP_X$ of a positive polarity as shown in FIG. 15 to the row electrodes $X_1$ to $X_k$ belonging to the row electrode set $S_1$ of PDP 10. Immediately thereafter, first sustaining driver 7 simultaneously applies a sustaining pulse $IP_Y$ of a positive polarity as shown in FIG. 15 to the row electrodes $Y_1$ to $Y_k$ belonging to the row electrode set S1 of PDP 10 (first emission sustaining process $I1_1$). By the alternating application of these sustaining pulses $IP_X$ and $IP_Y$, sustained discharge accompanying emission is caused twice only in the discharge cells, which belong to the abovementioned row electrode set S1 and are in the "emitting cell" state.

The charged particles, which had been formed by the selective erasure discharge in the above-described pixel data writing process $W_1$ but have decreased with the lapse of time, are thus reformed by the abovementioned two times of sustained discharge.

Also at the same time as the above-described first emission sustaining process $I1_1$, second sustaining driver 8 simultaneously applies a priming pulse $PP_X$ of a positive polarity as shown in FIG. 15 to the row electrodes $X_{k+1}$ to $X_{2k}$ belonging to the abovementioned row electrode set S2. At the same time as the application of this priming pulse $PP_X$, first sustaining driver 7 simultaneously applies a low-level cancel pulse CP of a positive polarity as shown in FIG. 15 to the row electrodes $Y_{2k+1}$ to $Y_n$ belonging to the abovementioned row electrode set S3. After the application of this cancel pulse CP, first sustaining driver 7 simultaneously applies a priming pulse $PP_Y$ of a positive polarity as shown in FIG. 15 to the row electrodes $Y_{k+1}$ to $Y_n$ belonging to the abovementioned row electrode sets S2 and S3 (priming process $Pc_2$). By the application of these priming pulses $PP_X$ and $PP_Y$, priming discharge is caused twice across only the row electrodes Y and X belonging to the abovementioned row electrode set S2, and charged particles are formed in the discharge space of the respective discharge cells belonging to this row electrode set S2. In each of the discharge cells belonging to row electrode set S3, to which the abovementioned cancel pulse CP has been applied, the abovementioned priming discharge is not caused even if priming pulse $PP_X$ or $PP_Y$ is applied.

After the execution of the above-described first emission sustaining process $I1_1$ and priming process $Pc_2$, address driver 6 extracts, from among the display drive data bits $DB1_{11-nm}$ corresponding to subfield SF1 as has been mentioned above, the data bits that correspond to the (k+1)th row to the 2kth row, in other words, $DB1_{(k+1),\ 1-2k,\ m}$. Address driver 6 then generates pixel data pulses of voltages corresponding to the respective logic levels of each of $DB1_{(k+1),\ 1-2k,\ m}$ and applies these data pulses successively to column electrodes $D_{1-m}$ as pixel data pulse sets $DP_{k+1}$ to $DP_{2k}$, each in correspondence to one row. In synchronization with each of these pixel data pulse sets $DP_{k+1}$ to $DP_{2k}$, second sustaining driver 8 generates negative-polarity scan pulses SP, with the same pulse width as the abovementioned data pulse DP, and successively applies these scan pulses to the row electrodes $Y_{k+1}$ to $Y_{2k}$ belonging to row electrode set S2 (pixel data writing process $W_2$). In this process, discharge (selective erasure discharge) is caused only in discharge cells, to which scan pulses SP have been applied and which at the same time belong to the abovementioned row electrode set S2 to which the high-voltage pixel data pulses have been applied, and the residual wall charge in the interior of such discharge cells disappears. That is, the discharge cells, which had been initialized to the "emitting cell" state in the above-described general reset process Rc undergo the transition to "non-emitting cells." Meanwhile, the abovementioned selective erasure discharge is not caused in discharge cells to which scan pulses SP have been applied and to which the low-voltage pixel data pulses have been applied as well, and the present states of these discharge cells are maintained.

As shown by $T_1$ to $T_k$ of FIG. 15, each of the abovementioned pixel data pulses DP and scan pulses SP, which are applied in the above-described pixel data writing process $W_2$, are made short in pulse width immediately after the above-described priming process $Pc_2$ and are then made wider in pulse width with the lapse of time. This is done since immediately after the priming process $Pc_2$, charged particles are formed in the discharge spaces of the respective discharge cells by the priming discharge caused by the priming process $Pc_2$ and selective erasure discharge can thus be carried out satisfactorily even if the scan pulses and the pixel data pulses are made short in pulse width.

After the execution of the above-described pixel data writing process $W_2$, second sustaining driver 8 simultaneously applies a sustaining pulse $IP_X$ of a positive polarity as shown in FIG. 15 to the row electrodes $X_1$ to $X_2$k belonging to the row electrode sets S1 and S2 of PDP 10. At the same time, first sustaining driver 7 simultaneously applies a low-level cancel pulse CP of a positive polarity as shown in FIG. 15 to the row electrodes $Y_1$ to $Y_k$ belonging to the abovementioned row electrode set S1. Immediately thereafter, first sustaining driver 7 simultaneously applies a sustaining pulse $IP_Y$ of a positive polarity as shown in FIG. 15 to the row electrodes $Y_1$ to $Y_{2k}$ belonging to the row electrode sets S1 and S2 of PDP 10 (first emission sustaining process 12). By the alternating application of these sustaining pulses $IP_X$ and $IP_Y$, sustained discharge accompanying light emission is caused twice only in the discharge cells, which belong to the abovementioned row electrode set S2 and are in the "emitting cell" state.

The charged particles, which had been formed by the selective erasure discharge in the above-described pixel data writing process $W_2$ but have decreased with the lapse of time, are thus reformed by the abovementioned two times of sustained discharge. The abovementioned sustained discharge does not occur, even if sustaining pulse $IP_X$ or $IP_Y$ is applied, in each of the discharge cells belonging to row electrode set S1 to which the abovementioned cancel pulse CP has been applied.

Also at the same time as the abovementioned first emission sustaining process $I1_2$, second sustaining driver 8 simultaneously applies a priming pulse $PP_X$ of a positive polarity as shown in FIG. 15 to the row electrodes $X_{2k+1}$ to $X_n$ belonging to the row electrode set S3 of PDP 10. After the application of this priming pulse $PP_X$, first sustaining driver 7 simultaneously applies a priming pulse $PP_Y$ of a positive polarity as shown in FIG. 15 to the row electrodes $Y_{2k+1}$ to $Y_n$ belonging to the abovementioned row electrode set S3 of PDP 10 (priming process $Pc_3$). By the application of these priming pulses $PP_X$ and $PP_Y$, priming discharge is caused twice across only the row electrodes Y and X belonging to the abovementioned row electrode set S3, and charged particles are formed in the discharge space of the respective discharge cells belonging to this row electrode set S3.

After the execution of the above-described first emission sustaining process $I1_2$ and priming process $Pc_3$, address driver 6 extracts, from among the display drive data bits $DB1_{11-nm}$ corresponding to subfield SF1 as has been mentioned above, the data bits that correspond to the (2k+1)th row to the nth row, in other words, $DB1_{(2k+1),\ 1-n\ m}$. Address driver 6 then generates pixel data pulses of voltages corresponding to the respective logic levels of each of $DB1_{(2k+1),\ 1-n,\ m}$ and applies these data pulses successively to column electrodes $D_{1-m}$ as pixel data pulse sets $DP_{2k+1}$ to $DP_n$, each in correspondence to one row. In synchronization with each of these pixel data pulse sets $DP_{2k+1}$ to $DP_n$, second sustaining driver 8 generates negative-polarity scan pulses SP, with the same pulse widths as the abovementioned data pulses DP, and successively applies these scan pulses to the row electrodes $Y_{2k+1}$ to $Y_n$ belonging to row electrode set S3 (pixel data writing process $W_3$). In this process, discharge (selective erasure discharge) is caused only in discharge cells, to which scan pulses SP have been applied and which at the same time belong to the abovementioned row electrode set S3 to which the high-voltage pixel data pulses have been applied, and the residual wall charge in the interior of such discharge cells disappears. That is, the discharge cells, which had been initialized to the "emitting cell" state in the above-described general reset process Rc undergo the transition to "non-emitting cells." Meanwhile, the abovementioned selective erasure discharge is not caused in discharge cells, to which scan pulses SP have been applied but to which the low-voltage pixel data pulses have been applied as well, and the present states of these discharge cells are maintained.

As shown by $T_1$ to $T_k$ of FIG. 15, each of the abovementioned pixel data pulses DP and scan pulses SP, which are applied in the above-described pixel data writing process $W_3$, are made short in pulse width immediately after the above-described priming process $Pc_3$ and are then made wider in pulse width with the lapse of time. This is done since immediately after the priming process $Pc_3$, charged particles are formed in the discharge spaces of the respective discharge cells by the priming discharge caused by the priming process $Pc_3$ and selective erasure discharge can thus be carried out satisfactorily even if the scan pulses and the pixel data pulses are made short in pulse width.

After the execution of the above-described pixel data writing process $W_3$, second sustaining driver 8 simultaneously applies a sustaining pulse $IP_X$ of a positive polarity as shown in FIG. 15 to all row electrodes $X_1$ to $X_n$ of PDP 10. At the same time, first sustaining driver 7 simultaneously applies a low-level cancel pulse CP of a positive polarity as shown in FIG. 15 to the row electrodes $Y_1$ to $Y_{2k}$ belonging to the abovementioned row electrode sets S1 and S2. Immediately thereafter, first sustaining driver 7 simultaneously applies a sustaining pulse $IP_Y$ of a positive polarity as shown in FIG. 15 to all row electrodes $Y_1$ to $Y_n$ of PDP 10 (first emission sustaining process $I1_3$). By the alternating application of these sustaining pulses $IP_X$ and $IP_Y$, sustained discharge accompanying emission is caused twice only in the discharge cells, which belong to the abovementioned row electrode set S3 and are in the "emitting cell" state.

The charged particles, which had been formed by the selective erasure discharge in the above-described pixel data writing process $W_3$ but have decreased with the lapse of time, are thus reformed by the abovementioned two times of sustained discharge. The abovementioned sustained discharge does not occur, even if sustaining pulse $IP_X$ or $IP_Y$ is applied, in each of the discharge cells belonging to row electrode sets S1 and S2 to which the abovementioned cancel pulse CP has been applied.

Second sustaining driver 8 then simultaneously applies a sustaining pulse $IP_X$ of a positive polarity as shown in FIG. 15 to all row electrodes $X_1$ to $X_n$ of PDP 10. At the same time, first sustaining driver 7 simultaneously applies a low-level cancel pulse CP of a positive polarity as shown in FIG. 15 to the row electrodes $Y_{2k+1}$ to $Y_n$ belonging to the abovementioned row electrode sets S2 and S3. Immediately thereafter, first sustaining driver 7 simultaneously applies a sustaining pulse $IP_Y$ of a positive polarity as shown in FIG. 15 to all row electrodes $Y_1$ to $Y_n$ of PDP 10 (third emission sustaining process $I3_1$). By the alternating application of these sustaining pulses $IP_X$ and $IP_Y$, sustained discharge accompanying light emission is caused twice only in the discharge cells, which belong to the abovementioned row electrode set S1 and are in the "emitting cell" state. The abovementioned sustained discharge does not occur, even if sustaining pulse $IP_X$ or $IP_Y$ is applied, in each of the discharge cells belonging to row electrode sets S2 and S3 to which the abovementioned cancel pulse CP has been applied.

After the execution of the above-described third emission sustaining process $I3_1$, address driver 6 extracts, from among the display drive data bits $DB1_{11-nm}$ to $DB14_{11-nm}$ supplied from the abovementioned memory 4, the data bits that correspond to the subfield SF2, in other words, the display drive data bits $DB2_{11-nm}$., and furthermore extracts from these data bits those that correspond to the 1st to kth rows, in other words, $DB2_{11-km}$. Address driver 6 then generates pixel data pulses of voltages corresponding to the respective logic levels of each of $DB2_{11-km}$ and applies these data pulses successively to column electrodes $D_{1-m}$ as pixel data pulse sets $DP_1$ to $DP_k$, each in correspondence to one row. That is, first the data bits among the abovementioned $DB2_{11-km}$ that correspond to the 1st row, in other words, $DB2_{11-1m}$ are extracted and the pixel data pulse set $DP_1$, comprised of m pixel data pulses corresponding to the respective logic levels of $DB2_{11-1m}$, is generated and applied to column electrodes $D_{1-m}$. Then the $DB2_{21-2m}$, which correspond to the 2nd row, are extracted from $DB2_{11-km}$, and the pixel data pulse set $DP_2$, comprised of m pixel data pulses corresponding to the respective logic levels of $DB2_{21-2m}$, is generated and applied to column electrodes $D_{1-m}$. Thereafter in the abovementioned pixel data writing process $W_1$ in subfield SF2, address driver 6 successively applies the pixel data pulses $DP_3$ to $DP_k$, respectively corresponding to the 3rd to kth rows of PDP 10 and each being applied in correspondence to one row, to column electrodes $D_{1-m}$ in likewise manner. Second sustaining driver 8 generates a negative-polarity scan pulses SP, of the same pulse widths as the abovementioned pixel data pulses DP, in synchronization with each of the above pixel data pulse sets $DP_1$ to $DP_k$ and applies these scan pulses SP successively to the row electrodes $Y_1$ to $Y_k$ belonging to row electrode set S1 (pixel data writing process $W_1$). In this process, selective erasure discharge occurs only in the discharge cells to which scan pulses SP have been applied and which at the same time belong to the abovementioned row electrode set S1 to which the high-voltage pixel data pulses have been applied, and the residual wall charge in such discharge cells disappears. That is, the discharge cells, which had been initialized in the general reset process Rc to the "emitting cell" state, undergo the transition to "non-emitting cells." On the other hand, since the abovementioned selective erasure discharge is not caused in discharge cells to which scan pulses SP have been applied but to which the low-voltage pixel data pulses have been applied as well, the present states of these discharge cells are maintained.

As shown by $T_1$ to $T_k$ of FIG. 15, each of the abovementioned pixel data pulses DP and scan pulses SP, which are applied in the above-described pixel data writing process $W_1$ in subfield SF2, are made short in pulse width immediately after the above-described emission sustaining process $I3_1$ and are then made wider in pulse width with the lapse of time. This is done since immediately after the emission sustaining process $I3_1$, charged particles are formed in the discharge spaces of the respective discharge cells by the sustained discharge caused by the sustained discharge process $I3_1$ and selective erasure discharge can thus be carried out satisfactorily even if the scan pulses and the pixel data pulses are made short in pulse width.

After the execution of the above-described pixel data writing process $W_1$ in subfield SF2, second sustaining driver 8 simultaneously applies a sustaining pulse $IP_X$ of a positive polarity as shown in FIG. 15 to all row electrodes $X_1$ to $X_n$ of PDP 10. At the same time, first sustaining driver 7 simultaneously applies a low-level cancel pulse CP of a positive polarity as shown in FIG. 15 to the row electrodes Y belonging to the abovementioned row electrode sets S1 and S3. Immediately thereafter, first sustaining driver 7 simultaneously applies a sustaining pulse $IP_Y$ of a positive polarity as shown in FIG. 15 to all row electrodes $Y_1$ to $Y_n$ of PDP 10 (third emission sustaining process $I3_2$). By the alternating application of these sustaining pulses $IP_X$ and $IP_Y$, sustained discharge accompanying emission is caused twice only in the discharge cells, which belong to the abovementioned row electrode set S2 and are in the "emitting cell" state. The abovementioned sustained discharge does not occur, even if sustaining pulse $IP_X$ or $IP_Y$ is applied, in each of the discharge cells belonging to row electrode sets S1 and S3 to which the abovementioned cancel pulse CP has been applied.

After the execution of the above-described third emission sustaining process $I3_2$, address driver 6 extracts, from among the display drive data bits $DB2_{11-nm}$ corresponding to subfield SF2 as has been mentioned above, the data bits that correspond to the (k+1)th to 2kth rows, in other words, $DB2_{k+1,\ 1-2k,\ m}$. Address driver 6 then generates pixel data pulses of voltages corresponding to the respective logic levels of each of $DB2_{k+1,\ 1-2k,\ m}$ and applies these data pulses successively to column electrodes $D_{1-m}$ as pixel data pulse sets $DP_{k+1}$ to $DP_{2k}$, each in correspondence with one row. Second sustaining driver 8 generates negative-polarity scan pulses SP, of the same pulse widths as the abovementioned pixel data pulses DP, in synchronization with each of the above pixel data pulse sets $DP_{k+1}$ to $DP_{2k}$ and applies these scan pulses SP successively to the row electrodes $Y_{k+1}$ to $Y_{2k}$ belonging to the abovementioned row electrode set S2 (pixel data writing process $W_2$). In this process, selective erasure discharge occurs only in discharge cells to which scan pulses SP have been applied and which at the same time belong to the abovementioned row electrode set S2 to which the high-voltage pixel data pulses have been applied, and the residual wall charge in such discharge cells disappears. That is, the discharge cells, which had been initialized in the general reset process Rc to the "emitting cell" state, undergo the transition to "non-emitting cells." On the other hand, since the abovementioned selective erasure discharge is not caused in discharge cells to which scan pulses SP have been applied but to which the low-voltage pixel data pulses have been applied as well, the present states of these discharge cells are maintained.

As shown by $T_1$ to $T_k$ of FIG. 15, each of the abovementioned pixel data pulses DP and scan pulses SP, which are applied in the above-described pixel data writing process $W_2$ in subfield SF2, are made short in pulse width immediately after the above-described emission sustaining process $I3_2$ and are then made wider in pulse width with the lapse of time. This is done since immediately after the emission sustaining process $I3_2$, charged particles are formed in the discharge spaces of the respective discharge cells by the sustained discharge caused by the sustained discharge process $I3_2$ and selective erasure discharge can thus be carried out satisfactorily even if the scan pulses and the pixel data pulses are made short in pulse width.

After the execution of the above-described pixel data writing process $W_2$ in subfield SF2, second sustaining driver 8 simultaneously applies a sustaining pulse $IP_X$ of a positive polarity as shown in FIG. 15 to all row electrodes $X_1$ to $X_n$ of PDP 10. At the same time, first sustaining driver 7 simultaneously applies a low-level cancel pulse CP of a positive polarity as shown in FIG. 15 to the row electrodes Y belonging to the abovementioned row electrode sets S1 and S2. Immediately thereafter, first sustaining driver 7 simultaneously applies a sustaining pulse $IP_Y$ of a positive polarity as shown in FIG. 15 to all row electrodes $Y_1$ to $Y_n$ of PDP 10 (third emission sustaining process $I3_3$). By the alternating application of these sustaining pulses $IP_X$ and $IP_Y$, sustained discharge accompanying emission is caused twice only in the discharge cells, which belong to the abovementioned row electrode set S3 and are in the "emitting cell" state. The abovementioned sustained discharge does not occur, even if sustaining pulse $IP_X$ or $IP_Y$ is applied, in each of the discharge cells belonging to row electrode sets S1 and S3 to which the abovementioned cancel pulse CP has been applied.

After the execution of the above-described third emission sustaining process $I3_3$, address driver 6 extracts, from among the display drive data bits $DB2_{11-nm}$ corresponding to subfield SF2 as has been mentioned above, the data bits that correspond to the (2k+1)th to nth rows, in other words, $DB_{2k+1,\ 1-n,\ m}$. Address driver 6 then generates pixel data pulses of voltages corresponding to the respective logic levels of each of $DB_{2k+1,\ 1-n,\ m}$ and applies these data pulses successively to column electrodes $D_{1-m}$ as pixel data pulse sets $DP_{2k+1}$ to $DP_n$, each in correspondence to one row. Second sustaining driver 8 generates negative-polarity scan pulses SP, of the same pulse widths as the abovementioned pixel data pulses DP, in synchronization with each of the above pixel data pulse sets $DP_{2k+1}$ to $DP_n$ and applies these scan pulses SP successively to the row electrodes $Y_{2k+1}$ to $Y_n$ belonging to the row electrode set S3 (pixel data writing process $W_3$). In this process, selective erasure discharge occurs only in discharge cells to which scan pulses SP have been applied and which at the same time belong to the abovementioned row electrode set S3 to which the high-voltage pixel data pulses have been applied, and the residual wall charge in such discharge cells disappears. That is, the discharge cells, which had been initialized in the general reset process Rc to the "emitting cell" state, undergo the transition to "non-emitting cells." On the other hand, since the abovementioned selective erasure discharge is not caused in discharge cells to which scan pulses SP have been applied but to which the low-voltage pixel data pulses have been applied as well, the present states of these discharge cells are maintained.

As shown by $T_1$ to $T_k$ of FIG. 15, each of the abovementioned pixel data pulses DP and scan pulses SP, which are applied in the above-described pixel data writing process $W_3$ in subfield SF3, are made short in pulse width immediately after the above-described emission sustaining process $I3_3$ and are then made wider in pulse width with the lapse of time. This is done since immediately after the emission sustaining process $I3_3$, charged particles are formed in the discharge spaces of the respective discharge cells by the sustained discharge caused by the sustained discharge process $I3_3$ and selective erasure discharge can thus be carried out satisfactorily even if the scan pulses and the pixel data pulses are made short in pulse width.

As has been described above, in the first subfield SF1, first the general reset process Rc, by which all discharge cells of PDP 10 are initialized to the "emitting cell" state, is executed. Next the priming processes $Pc_1$ to $Pc_3$, by which charged particles are formed in the discharge cells, the pixel data writing processes $W_1$ to $W_3$, by which each discharge cell is set to an "emitting cell" or "non-emitting cell" in accordance with the pixel data, and the first emission sustaining processes $I1_1$ to $I1_3$ and third emission sustaining processes $I3_1$ to $I3_3$, by which only the "emitting cells" are made to emit light twice respectively, are executed successively.

On the other hand, in each of subfields SF2 to SF13, the pixel data writing processes $W_1$ to $W_3$, the first emission sustaining processes $I1_1$ to $I1_3$, and the third emission sustaining processes $I3_1$ to $I3_3$ are executed successively in the same manner as in the abovementioned subfield SF1 as shown in FIG. 14. Furthermore in each of subfields SF2 to SF13, a second emission sustaining process I2, by which all discharge cells set as the abovementioned "emitting cells" are made to undergo sustained discharge repeatedly and all at once by the number of times corresponding to the weighing of each subfield, is executed between the abovementioned first emission sustaining processes I1 and the third emission sustaining processes I3 as shown in FIG. 14.

In the last subfield SF14, the abovementioned pixel data writing processes $W_1$ to $W_3$, the first emission sustaining processes $I1_1$ to $I1_3$, the second emission sustaining processes I2, and an erasure process E, by which the wall charge remaining in all discharge cells are eliminated, are executed as shown in FIG. 14.

In the abovementioned second emission sustaining process I2, first sustaining driver 7 and second sustaining driver 8 repeatedly apply the abovementioned sustaining pulses $IP_X$ and $IP_Y$ alternately to the row electrodes $Y_1$ to $Y_n$ and $X_1$ to $X_n$ of PDP 10 as shown in FIG. 15. As shown in FIG. 16, in this process, the numbers of times of application of sustaining pulses $IP_X$ and $IP_Y$ are set as follows in accordance with the weighing of each subfield;

SF2: 8
SF3: 16
SF4: 28
SF5: 36
SF6: 48
SF7: 60
SF8: 72
SF9: 84
SF10: 96
SF11: 108
SF12: 124
SF13: 136
SF14: 154 and the discharge cells set as "emitting cells" emit light for the number of times the sustaining pulses are applied.

Here, the total number of times of emission in each subfield will be the sum of the number of times of emission in each of the abovementioned first emission sustaining process I1, second emission sustaining process I2, and third emission sustaining process I3. Since the number of times of emission in each of first emission sustaining process I1 and third emission sustaining process I3 is 2, the total number of times of emission in each of subfields SF1 to SF14 will be:

SF1: 4
SF2: 12
SF3: 20
SF4: 32
SF5: 40
SF6: 52
SF7: 64
SF8: 76
SF9: 88
SF10: 100
SF11: 112
SF12: 128
SF13: 140
SF14: 156

Whether or not a discharge cell is to be made to emit light for the number of times such as shown above in each subfield, that is, whether to set a discharge cell to an "emitting cell" or to a "non-emitting cell" is determined by the data pattern of display drive data GD, such as shown in FIG. 13. With this display drive data GD, selective erasure discharge is made to occur only in the pixel data writing process W of one of the subfields among the subfields SF1 to SF14 as indicated by the filled circles of FIG. 13. That is, the wall charge that is formed in the general reset process Rc of the first subfield SF1 remains and the "emitting cell" state is maintained until the abovementioned selective erasure discharge is caused. Sustained discharge accompanying light emission will thus be caused in the first emission sustaining processes I1 to I3 in each subfield (indicated by the unfilled circles) existing in between. Here, the total of the number of times of sustained discharge caused in each of subfields SF1 to SF14 is expressed as the emission luminance in one field.

The emission luminance obtained by 15 types of display drive data GD, such as shown in FIG. 13, will thus be of the 15 gradations,

{0 1, 4, 9, 16, 27, 40, 56, 75, 97, 122, 151, 182, 217, 256} when the emission luminance of subfield SF1 is expressed as "1."

By this 15-stage gradation drive and the above-described multi-level halftone process by multi-level halftone processing circuit 33, luminance equivalent to 256 gradation is expressed in visual terms.

As has been described above, with the present embodiment, the n row electrodes of PDP 10 are grouped into and handled as three row electrode sets S1 to S3, each comprised of k row electrodes, and immediately after the completion of each pixel data writing process (pixel data writing processes $W'_{1-3}$) on one row electrode set, the initial number of times (two times) of sustained discharge operation (first emission sustaining processes $I1'_{1-3}$) are executed on that electrode set. The charged particles which had been formed by the selective erasure discharge in the abovementioned pixel data writing process $W'_{1-3}$ but has decreased with the lapse of time are thus reformed by the sustained discharge.

Since the abovementioned charged particles thus remain in the discharge cells belonging to this row electrode set in the stage immediately before the subsequent sustained discharge (second emission sustaining process I2) is caused, sustained discharge will be caused correctly even if for example the pulse width of the sustaining pulse IP applied in the abovementioned second emission sustaining process I2 is short.

Furthermore, immediately prior to executing each of the pixel data writing processes $W'_{1-3}$ on each of the row electrode sets S1 to S3, each of the third emission sustaining processes $I3'_{1-3}$ for the previous subfield is executed. Thus in the stage immediately prior to each of the pixel data writing processes $W'_{1-3}$, the charged particles formed by the sustained discharge in the corresponding third emission sustaining process $I3'_{1-3}$ will remain. Selective erasure discharge will thus be made to occur satisfactorily even if the pulse widths of the scan pulses and pixel data pulses applied in each of pixel data writing processes $W'_{1-3}$ are short.

Thus with this invention, even if the pulse widths of the various drive pulses (scan pulse, pixel data pulse, sustaining pulse IP) to be applied to the PDP are made short to increase the number of subfield divisions, the various types of discharge (selective erasure discharge and sustained discharge) can be made to occur correctly and thus a good image display can be obtained.

Put in another way, since the time for the pixel data writing process in each subfield can be shortened, the number of subfields that can be inserted in a single field can be increased to thereby improve the display quality.

Though in FIG. 15, each of pixel data pulses DP and scan pulses SP to be applied to each of the row electrode sets S1, S2, and S3 is made wider in pulse width in the order of scanning in the electrode set in order to stabilize the selective erasure discharge in the pixel data writing processes for these row electrode sets, the respective pulse widths of pixel data pulses DP and scan pulses SP may be made short in accordance with the order of arrangement of the subfields in one field. In this case, since adequate priming particles will be formed and selective erasure discharge will be stable in a subfield that comes later in the order of arrangement, the pulse widths may be shortened in order starting from the first subfield in one field.

Also, with the embodiment shown in FIG. 13, selective erasure discharge is made to occur only in the pixel data writing process W in one of the subfields among subfields SF1 to SF14 as indicated by the filled circles. However, if the amount of charged particles remaining in the discharge cells is low, this selective erasure discharge may not occur correctly and the wall charge in the discharge cells may not be eliminated correctly. In this case, light emission corresponding to the maximum luminosity will be caused even if the pixel data D after A/D conversion indicate low luminosity and the image quality will thus be lowered significantly.

Gradation drive is thus performed upon changing the conversion table used in second data conversion circuit 34 from that shown in FIG. 13 to that shown in FIG. 17.

In FIG. 17, the "*" indicates that the logic level may be "1" or "0," and the triangle mark indicates that selective erasure discharge is to be made to occur only in the case where the logic level corresponding to the "*" is "1."

By the display drive data GD shown in FIG. 17, selective erasure discharge is performed at least twice continuously. That is, since the writing of pixel data may fail with just the first selective erasure discharge, selective erasure discharge is performed at least once again in a subsequent subfield to ensure the writing of pixel data and prevent erroneous light emission operation.

Figure 18:
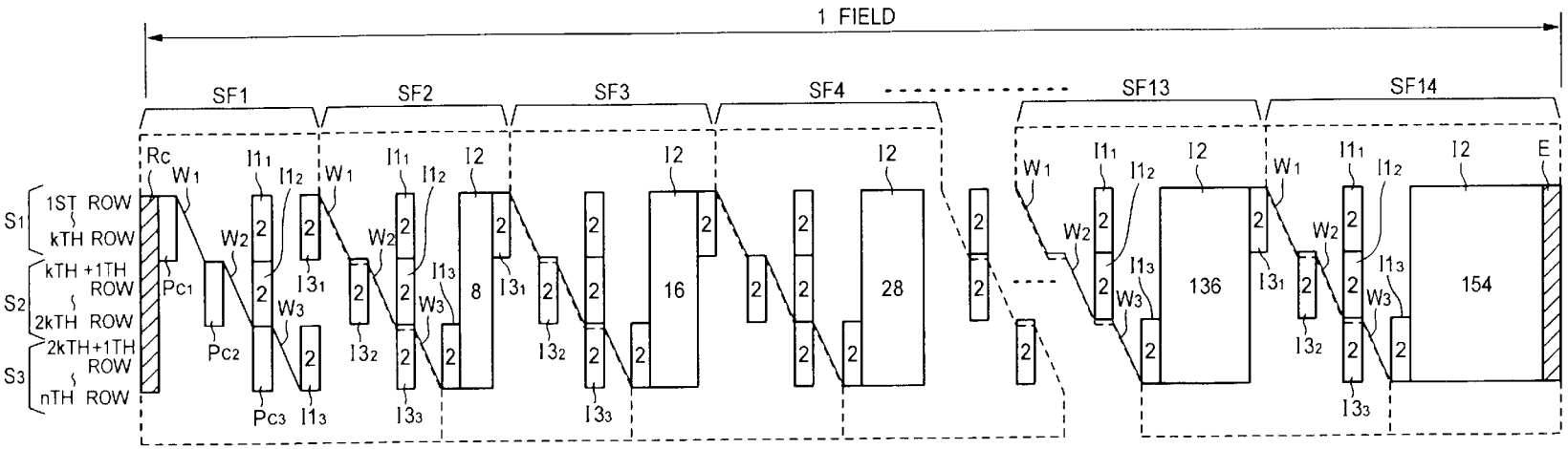
FIG. 18 is a diagram that shows another example of an emission drive format based on a drive method of this invention.

Though in the embodiment shown in FIG. 14, the first emission sustaining process $I1_1$ is executed immediately after the pixel data writing process $W_1$, this first emission sustaining process $I1_1$ and the second emission sustaining process $I1_2$ may be executed simultaneously as shown in FIG. 18.

Also in the embodiment shown in FIG. 14, since the total number of times of emission in subfield SF1 is set to four, the second emission sustaining process I does not exist in this subfield. However, if the total number of times of emission in this subfield is set to six or more, the second emission sustaining process I2 is inserted between the first emission sustaining process I1 and the second emission sustaining process I3, as in the subfields SF2 to SF14, and the emissions past the fourth emission are performed in this second emission sustaining process I2.

Also, though in the above-described embodiment, pixel data writing and the sustaining of emission are performed in group units, such as row electrode sets S1 to S3, in all subfields SF1 to SF14, pixel data writing and sustaining of emission do not necessarily have to be performed according to the abovementioned groups in all subfields. For example, the pixel data writing and sustaining of emission may be performed in accordance with the abovementioned group units in just the subfields SF1 to SF7, which, among the subfields SF1 to SF14, are relatively low in the total number of times of emission within a subfield.

With the emission drive formats shown in FIGS. 14 to 18, the interval from the completion of second emission sustaining process I2 to the start of the subsequent third emission sustaining process I3 differs according to each of row electrode sets S1 to S3. That is, with the discharge cells belonging to row electrode set S1, the third emission sustaining process $I3_1$ is started immediately after the completion of the second emission sustaining process I2. Thus many charged particles, generated in the stage of the second emission sustaining process I2, remain in the discharge cells belonging to row electrode set S1. Sustained emission is thus caused at substantially the same period in all discharge cells belonging to row electrode set S1 by the application of the sustaining pulse IP in the third emission sustaining process $I3_1$. The power consumption that accompanies the abovementioned sustained discharge is thus concentrated within this period, causing the power consumption of the entirety to increase. The voltage level of sustaining pulse IP will drop due to this increase of power consumption and as a result, the luminosity during emission accompanying the sustained discharge will drop.

Meanwhile, with the discharge cells belonging to row electrode set S3, some time is required from the completion of second emission sustaining process I2 to the start of third emission sustaining process $I3_3$. Thus in the discharge cells belonging to row electrode set S3, the charged particles that had been generated in the stage of the second emission sustaining process I2 will gradually disappear with the lapse of time. Since there is scattering among the degree of disappearance of the charged particles according to each discharge cell, there will be some discharge cells in which sustaining discharge occurs at a relatively early stage from the application of sustaining pulse IP as well as discharge cells in which sustaining discharge occurs at a late stage. Thus with the discharge cells belonging to row electrode set S3, the power consumption accompanying sustained discharge will be dispersed in time and the power consumption will not increase at a certain point in time. The voltage level of sustaining pulse IP will therefore not drop and the lowering of luminosity during emission accompanying sustained discharge will not occur as in the above-described case of discharge cells belonging to row electrode set S1.

Since a difference in luminosity will thus arise between the emission due to the sustained discharged caused in discharge cells belonging to row electrode set S1 and that due to the sustained discharge caused in discharge cells in row electrode set S3, a uniform display luminosity will not been obtained on the screen.

Figure 19:
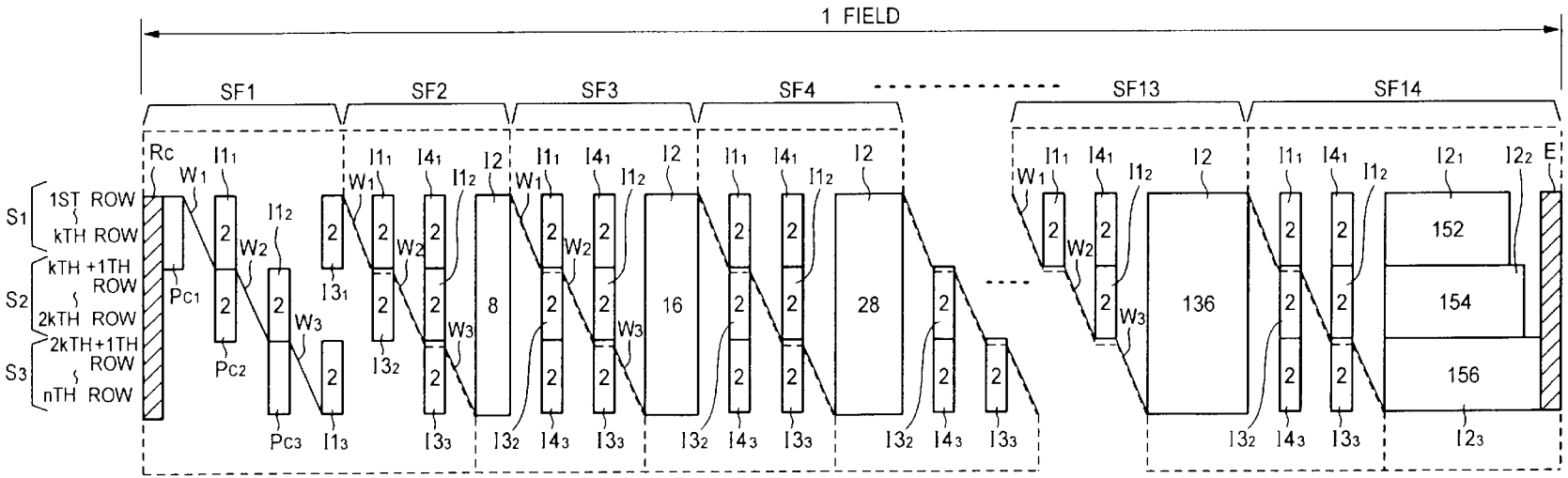
FIG. 19 is a diagram that shows another example of an emission drive format based on a drive method of this invention.

This problem is thus resolved by employing the display drive format shown in FIG. 19 in place of the display drive format shown in FIG. 14 or 18.

Figure 20:
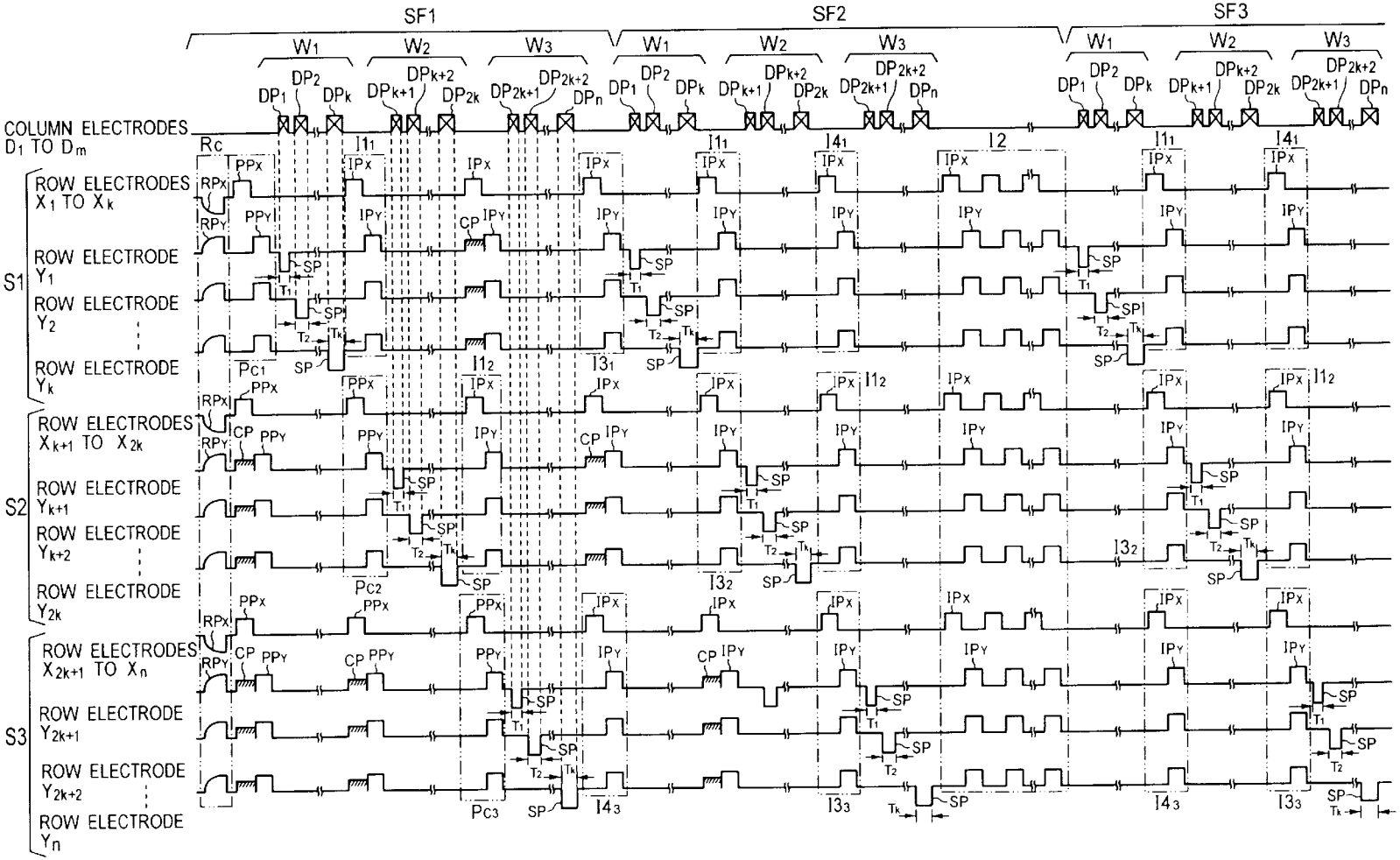
FIG. 20 is a diagram that shows part of the timings of application of the various drive pulses to be applied to the column electrodes and row electrodes of PDP 10 in accordance with the emission drive format shown in FIG. 19.

FIG. 20 is a diagram that shows the timing of application of the various drive pulses to be applied to PDP 10 in accordance with the emission drive format shown in FIG. 19. In FIG. 20 the timings of application of drive pulses in subfields SF1 and SF2, among the subfields SF1 to SF14 are excerpted and shown.

In FIG. 20, second sustaining driver 8 first generates a reset pulse $RP_X$ of a negative polarity in the subfield SF1 and applies this pulse to all row electrodes $X_1$ to $X_n$ of PDP 10 simultaneously. At the same time, first sustaining driver 7 generates a reset pulse $RP_Y$ of a positive polarity and applies this pulse to all row electrodes $Y_1$ to $Y_n$ of PDP 10 simultaneously (general reset process Rc). By the execution of this general reset process Rc, all discharge cells in PDP 10 undergo reset discharge and a predetermined wall charge is formed uniformly in the respective discharge cells. All discharge cells are thereby set once to "emitting cells."

After the completion of the above-described general reset process Rc, second sustaining driver 8 applies a priming pulse $PP_X$ of a positive polarity to all row electrodes $X_1$ to $X_n$ of PDP 10 simultaneously. At the same time as this application of priming pulse $PP_X$, first sustaining driver 7 simultaneously applies a low level cancel pulse CP of a positive polarity as shown in FIG. 20 to the row electrodes $Y_{k+1}$ to $Y_n$ belonging to the row electrode sets S2 and S3 of PDP 10. After the application of the cancel pulse CP, first sustaining driver 7 simultaneously applies a priming pulse $PP_Y$ of a positive polarity to all row electrodes $Y_1$ to $Y_n$ of PDP 10 (priming process $Pc_1$). By the execution of this priming process $Pc_1$, priming discharge is caused two times in the discharge cells belonging to row electrode set S1 of PDP 10, and charged particles are formed in the discharge spaces of the respective discharge cells belonging to this row electrode set S1. Discharge does not occur in the respective discharge cells belonging to the row electrode sets S2 and S3 to which the abovementioned cancel pulse CP was applied.

After the execution of the priming process $Pc_1$, address driver 6 selects, from among the display drive data bits $DB1_{11-nm}$, supplied from the abovementioned memory 4 and corresponding to subfield SF1, the data bits corresponding to the 1st to kth rows, in other words, $DB1_{11-km}$. Address driver 6 generates pixel data pulses of voltages corresponding to the respective logic levels of $DB1_{11-km}$, and successively applies these as pixel data pulse sets $DP_1$ to $DP_k$, each in correspondence to one row, to column electrodes $D_{1-m}$ Second sustaining driver 8 then generates, in synchronization with each of the pixel data pulse sets $DP_1$ to $DP_k$, negative-polarity scan pulses SP, of the same pulse widths as the abovementioned pixel data pulses DP, and applies these scan pulses SP successively to the row electrodes $Y_1$ to $Y_k$ belonging to the abovementioned row electrode set S1 (pixel data writing process $W_1$). In this process, discharge (selective erasure discharge) occurs only in the discharge cells to which scan pulses SP have been applied and which at the same time belong to the abovementioned row electrode set S1 to which the high-voltage pixel data pulses have been applied, and the residual wall charge in such discharge cells disappears. That is, the discharge cells, which had been initialized in the above-described general reset process Rc to the "emitting cell" state, undergo the transition to "non-emitting cells." On the other hand, since the abovementioned selective erasure discharge is not caused in discharge cells to which scan pulses SP have been applied but to which the low-voltage pixel data pulses have been applied as well, these are kept in the condition initialized by the abovementioned general reset process Rc, in other words, in the "emitting cell" state. As shown by $T_1$ to $T_k$ of FIG. 20, each of the abovementioned pixel data pulses DP and scan pulses SP, which are applied in the above-described pixel data writing process $W_1$, are made short in pulse width immediately after the above-described priming process $Pc_1$ and are then made wider in pulse width with the lapse of time.

After the execution of the above-described pixel data writing process $W_1$, second sustaining driver 8 simultaneously applies a sustaining pulse $IP_X$ of a positive polarity to the row electrodes $X_1$ to $X_k$ belonging to the row electrode set $S_1$ of PDP 10. Immediately thereafter, first sustaining driver 7 simultaneously applies a sustaining pulse $IP_Y$ of a positive polarity to the row electrodes $Y_1$ to $Y_k$ belonging to the row electrode set S1 of PDP 10 (first emission sustaining process $I1_1$). By the alternating application of these sustaining pulses $IP_X$ and $IP_Y$, sustained discharge accompanying emission is caused twice only in the discharge cells, which belong to the abovementioned row electrode set S1 and are in the "emitting cell" state. The charged particles, which had been formed by the selective erasure discharge in the above-described pixel data writing process $W_1$ but have decreased with the lapse of time, are thus reformed by the abovementioned two times of sustained discharge.

Also at the same time as the abovementioned first emission sustaining process $I1_1$, second sustaining driver 8 simultaneously applies a priming pulse $PP_X$ of a positive polarity to the row electrodes $X_{k+1}$ to $X_n$ belonging to the abovementioned row electrode sets S2 and S3. At the same time as the application of this priming pulse $PP_X$, first sustaining driver 7 simultaneously applies a low-level cancel pulse CP of a positive polarity to the row electrodes $Y_{2k+1}$ to $Y_n$ belonging to the abovementioned row electrode set S3. After the application of this cancel pulse CP, first sustaining driver 7 simultaneously applies a priming pulse $PP_Y$ of a positive polarity to the row electrodes $Y_{k+1}$ to $Y_n$ belonging to the abovementioned row electrode sets S2 and S3 (priming process $Pc_2$). By the execution of this priming process $Pc_2$, priming discharge is caused twice across only the row electrodes Y and X belonging to the abovementioned row electrode set S2 of PDP 10, and charged particles are formed in the discharge space of the respective discharge cells belonging to this row electrode set S2. Discharge does not occur in each of the discharge cells belonging to row electrode set S3 to which the abovementioned cancel pulse CP has been applied.

After the execution of the above-described first emission sustaining process $I1_1$ and priming process $Pc_2$, address driver 6 extracts, from among the abovementioned display drive data bits $DB1_{11-nm}$, the data bits corresponding to the (k+1)th row to the 2kth row, in other words, $DB1_{(k+1),\ 1-2k,\ m}$. Address driver 6 then generates pixel data pulses of voltages corresponding to the respective logic levels of each of $DB1_{(k+1),\ 1-2k,\ m}$ and applies these data pulses successively to column electrodes $D_{1-m}$ as pixel data pulse sets $DP_{k+1}$ to $DP_{2k}$, each in correspondence to one row. In synchronization with each of these pixel data pulse sets $DP_{k+1}$ to $DP_{2k}$, second sustaining driver 8 generates negative-polarity scan pulses SP, with the same pulse widths as the abovementioned data pulses DP, and successively applies these scan pulses to the row electrodes $Y_{k+1}$ to $Y_{2k}$ belonging to row electrode set S2 (pixel data writing process $W_2$). In this pixel data writing process $W_2$, discharge (selective erasure discharge) is caused only in discharge cells, to which scan pulses SP have been applied and which at the same time belong to the abovementioned row electrode set S2 to which the high-voltage pixel data pulses have been applied, and the residual wall charge in the interior of such discharge cells disappears. That is, the discharge cells, which had been initialized to the "emitting cell" state in the above-described general reset process Rc undergo the transition to "non-emitting cells." Meanwhile, the abovementioned selective erasure discharge is not caused in discharge cells, to which scan pulses SP have been applied but to which the low-voltage pixel data pulses have been applied as well, and the present states of these discharge cells are maintained. As shown by $T_1$ to $T_k$ of FIG. 20, each of the abovementioned pixel data pulses DP and scan pulses SP, which are applied in the above-described pixel data writing process $W_2$, are made short in pulse width immediately after the above-described priming process $Pc_2$ and are then made wider in pulse width with the lapse of time.

After the execution of the above-described pixel data writing process $W_2$, second sustaining driver 8 simultaneously applies a sustaining pulse $IP_X$ of a positive polarity to the row electrodes $X_1$ to $X_{2k}$ belonging to row electrode sets S1 and S2 of PDP 10. At the same time, first sustaining driver 7 simultaneously applies a low-level cancel pulse CP of a positive polarity to the row electrodes $Y_1$ to $Y_k$ belonging to the abovementioned row electrode set S1. Immediately thereafter, first sustaining driver 7 simultaneously applies a sustaining pulse $IP_Y$ of a positive polarity to the row electrodes $Y_1$ to $Y_{2k}$ belonging to the row electrode sets S1 and S2 of PDP 10 (first emission sustaining process $I1_2$). By the alternating application of these sustaining pulses $IP_X$ and $IP_Y$, sustained discharge accompanying emission is caused twice only in the discharge cells, which belong to the abovementioned row electrode set S2 and are in the "emitting cell" state. The charged particles, which had been formed by the selective erasure discharge in the above-described pixel data writing process $W_2$ but have decreased with the lapse of time, are thus reformed by the abovementioned two times of sustained discharge. Discharge does not occur in the respective discharge cells belonging to row electrode set S1 to which the abovementioned cancel pulse CP has been applied.

Also at the same time as the above-described first emission sustaining process 12, second sustaining driver 8 simultaneously applies a priming pulse $PP_X$ of a positive polarity to the row electrodes $X_1$ to $X_k$ belonging to row electrode set S3 of PDP 10. After the application of this priming pulse $PP_X$, first sustaining driver 7 simultaneously applies a priming pulse $PP_Y$ of a positive polarity to the row electrodes $Y_{2k+1}$ to $Y_n$ belonging to row electrode set S3 of PDP 10 (priming process $Pc_3$). By the execution of this priming process $Pc_3$, priming discharge is caused twice only in the discharge cells belonging to the abovementioned row electrode set S3 of PDP 10, and charged particles are formed in the discharge space of the respective discharge cells belonging to this row electrode set S3.

After the execution of this first emission sustaining process $I1_2$ and priming process $Pc_3$, address driver 6 extracts, from among the abovementioned display drive data bits $DB1_{11-nm}$, the data bits corresponding to the (2k+1)th row to the nth row, in other words, $DB1_{(2k+1),\ 1-n,\ m}$. Address driver 6 then generates pixel data pulses of voltages corresponding to the respective logic levels of each of $DB1_{(2k+1),\ 1-n,\ m}$ and applies these data pulses successively to column electrodes $D_{1-m}$ as pixel data pulse sets $DP_{2k+1}$ to $DP_n$, each in correspondence with one row. In synchronization with each of these pixel data pulse sets $DP_{2k+1}$ to $DP_n$, second sustaining driver 8 generates negative-polarity scan pulses SP, with the same pulse widths as the abovementioned data pulses DP, and successively applies these scan pulses to the row electrodes $Y_{2k+1}$ to $Y_n$ belonging to row electrode set S3 (pixel data writing process $W_3$). In this pixel data writing process $W_3$, discharge (selective erasure discharge) is caused only in discharge cells, to which scan pulses SP have been applied and which belong to the row electrode set S3 to which the high-voltage pixel data pulses have been applied, and the residual wall charge in the interior of such discharge cells disappears. That is, the discharge cells, which had been initialized to the "emitting cell" state in the above-described general reset process Rc undergo the transition to "non-emitting cells." Meanwhile, the abovementioned selective erasure discharge is not caused in discharge cells, to which scan pulses SP have been applied but to which the low-voltage pixel data pulses have been applied as well, and the present states of these discharge cells are maintained. As shown by $T_1$ to $T_k$ of FIG. 20, each of the abovementioned pixel data pulses DP and scan pulses SP, which are applied in the above-described pixel data writing process $W_3$, are made short in pulse width immediately after the above-described priming process $Pc_3$ and are then made wider in pulse width with the lapse of time.

After the execution of the above-described pixel data writing process $W_3$, second sustaining driver 8 simultaneously applies a sustaining pulse $IP_X$ of a positive polarity to the row electrodes $X_{2k+1}$ to $X_n$ belonging to the row electrode set S3 of PDP 10. Immediately thereafter, first sustaining driver 7 simultaneously applies a sustaining pulse $IP_Y$ of a positive polarity to the row electrodes $Y_{2k+1}$ to $Y_n$ belonging to row electrode set S3 of PDP 10 (first emission sustaining process $I1_3$). By the execution of this first emission sustaining process $I1_3$, sustained discharge accompanying emission is caused twice only in the discharge cells, which belong to the abovementioned row electrode set S3 and are in the "emitting cell" state.

At the same time as the above-described first emission sustaining process $I1_3$, second sustaining driver 8 simultaneously applies a sustaining pulse $IP_X$ of a positive polarity to the row electrodes $X_1$ to $X_k$ belonging to row electrode set S1 of PDP 10. Immediately thereafter, first sustaining driver 7 simultaneously applies a sustaining pulse $IP_Y$ of a positive polarity to the row electrodes $Y_1$ to $Y_k$ belonging to row electrode set S1 of PDP 10 (third emission sustaining process $I3_1$). By the execution of this third emission sustaining process $I3_1$, sustained discharge accompanying emission is caused twice only in the discharge cells, which belong to the abovementioned row electrode set S1 and are in the "emitting cell" state.

Also at the same time as the above-described first emission sustaining process $I1_3$ and third emission sustaining process $I3_1$, second sustaining driver 8 simultaneously applies a sustaining pulse $IP_X$ of a positive polarity to the row electrodes $X_{k+1}$ to $X_{2k}$ belonging to row electrode set S2 of PDP 10. At the same time, first sustaining driver 7 simultaneously applies a low-level cancel pulse CP of a positive polarity as shown in FIG. 20 to the row electrodes $Y_{k+1}$ to $Y_{2k}$ belonging to row electrode set S2. In this process, discharge does not occur in the discharge cells belonging to the row electrode set S2 to which the abovementioned cancel pulse CP has been applied.

Upon completion of the above-described third emission sustaining process $I3_1$ in subfield SF1, address driver 6 extracts, from among the display drive data bits $DB2_{11-nm}$, corresponding to subfield SF2 and supplied from the abovementioned memory 4, the data bits corresponding the 1st row to the kth row, in other words, $DB2_{11-km}$. Address driver 6 then generates pixel data pulses of voltages corresponding to the respective logic levels of each of $DB2_{11-km}$ and applies these data pulses successively to column electrodes $D_{1-m}$ as pixel data pulse sets $DP_1$ to $DP_k$, each in correspondence to one row. In synchronization with each of the above pixel data pulse sets $DP_1$ to $DP_k$, second sustaining driver 8 generates negative-polarity scan pulses SP, of the same pulse widths as the abovementioned pixel data pulses DP, and applies these scan pulses SP successively to the row electrodes $Y_1$ to $Y_k$ belonging to the abovementioned row electrode set S1 (pixel data writing process $W_1$). In this pixel data writing process $W_1$, discharge (selective erasure discharge) occurs only in discharge cells to which scan pulses SP have been applied and which at the same time belong to the abovementioned row electrode set S1 to which the high-voltage pixel data pulses have been applied, and the residual wall charge in such discharge cells disappears. That is, the discharge cells, which had been initialized in the above-described general reset process Rc to the "emitting cell" state, undergo the transition to "non-emitting cells." On the other hand, since the abovementioned selective erasure discharge is not caused in discharge cells to which scan pulses SP have been applied but to which the low-voltage pixel data pulses have been applied as well, these discharge cells are maintained in the condition initialized by the above-described general reset process Rc, that is, in the "emitting cell" state.

After the execution of the above-described pixel data writing process $W_1$, second sustaining driver 8 simultaneously applies a sustaining pulse $IP_X$ of a positive polarity to the row electrodes $X_1$ to $X_k$ belonging to row electrode set S1 of PDP 10. Immediately thereafter, first sustaining driver 7 simultaneously applies a sustaining pulse $IP_Y$ of a positive polarity to the row electrodes $Y_1$ to $Y_k$ belonging to row electrode set S1 of PDP 10 (first emission sustaining process $I1_1$). By the execution of this first emission sustaining process $I1_1$, sustained discharge accompanying emission is caused twice only in the discharge cells, which belong to the abovementioned row electrode set S1 and are in the "emitting cell" state. The charged particles which had been formed by the selective erasure discharge in the above-described pixel data writing process $W_1$ but have decreased with the lapse of time are thus reformed by the abovementioned two times of sustained discharge.

At the same time as the above-described first emission sustaining process $I1_1$ in subfield SF2, second sustaining driver 8 simultaneously applies a sustaining pulse $IP_X$ of a positive polarity to the row electrodes $X_{k+1}$ to $X_{2k}$ belonging to row electrode set S2 of PDP 10. Immediately after this application of sustaining pulse $IP_X$, first sustaining driver 7 simultaneously applies a sustaining pulse $IP_Y$ of a positive polarity to the row electrodes $Y_{k+1}$ to $Y_{2k}$ belonging to row electrode set S2 of PDP 10 (third emission sustaining process $I3_2$). By the execution of this third emission sustaining process $I3_2$, sustained discharge accompanying emission is caused twice only in the discharge cells, which belong to the abovementioned row electrode set S2 and are in the "emitting cell" state.

After the completion of the above-described first emission sustaining process $I1_1$ in subfield SF2 and the third emission sustaining process $I3_2$ in subfield SF1, address driver 6 extracts, from among the display drive data bits $DB2_{11-nm}$ corresponding to subfield SF2, the data bits corresponding to the (k+1)th to 2kth rows, in other words, $DB1_{(k+1),\ 1-2k,\ m}$. Address driver 6 then generates pixel data pulses of voltages corresponding to the respective logic levels of each of $DB2_{(k+1),\ 1-2k,\ m}$ and applies these data pulses successively to column electrodes $D_{1-m}$ as pixel data pulse sets $DP_{k+1}$ to $DP_{2k}$, each in correspondence to one row. Second sustaining driver 8 generates negative-polarity scan pulses SP, of the same pulse widths as the abovementioned pixel data pulses DP, in synchronization with each of the above pixel data pulse sets $DP_{k+1}$ to $DP_{2k}$ and applies these scan pulses SP successively to the row electrodes $Y_{k+1}$ to $Y_{2k}$ belonging to the row electrode set S2 (pixel data writing process $W_2$). In this pixel data writing process $W_2$, discharge (selective erasure discharge) occurs only in discharge cells belonging to the abovementioned row electrode set S2 to which scan pulses SP and the high-voltage pixel data pulses have been applied at the same time, and the residual wall charge in such discharge cells disappears. That is, the discharge cells, which had been initialized in the general reset process Rc to the "emitting cell" state, undergo the transition to "non-emitting cells." On the other hand, since the abovementioned selective erasure discharge is not caused in discharge cells to which scan pulses SP have been applied but to which the low-voltage pixel data pulses have been applied as well, these discharge cells are maintained in the condition initialized by the above-described general reset process Rc, in other words, in the "emitting cell" state.

After the execution of the above-described pixel data writing process $W_2$, second sustaining driver 8 simultaneously applies a sustaining pulse $IP_X$ of a positive polarity to the row electrodes $X_1$ to $X_k$ belonging to row electrode set S1 of PDP 10. Immediately thereafter, first sustaining driver 7 simultaneously applies a sustaining pulse $IP_Y$ of a positive polarity to the row electrodes $Y_1$ to $Y_k$ belonging to row electrode set S1 of PDP 10 (fourth emission sustaining process $I4_1$). By the execution of this fourth emission sustaining process $I4_1$, sustained discharge accompanying emission is caused twice only in the discharge cells, which belong to the abovementioned row electrode set S1 and are in the "emitting cell" state.

At the same time as the above-described fourth emission sustaining process $I4_1$, second sustaining driver 8 simultaneously applies a sustaining pulse $IP_X$ of a positive polarity to the row electrodes $X_{k+1}$ to $X_{2k}$ belonging to row electrode set S2 of PDP 10. Immediately after this sustaining pulse $IP_X$, first sustaining driver 7 simultaneously applies a sustaining pulse $IP_Y$ of a positive polarity to the row electrodes $Y_{k+1}$ to $Y_{2k}$ belonging to row electrode set S2 of PDP 10 (first emission sustaining process $I1_2$). By the execution of this first emission sustaining process $I1_2$, sustained discharge accompanying emission is caused twice only in the discharge cells, which belong to the abovementioned row electrode set S2 and are in the "emitting cell" state.

Also at the same time as the above-described fourth emission sustaining process $I4_1$, second sustaining driver 8 simultaneously applies a sustaining pulse $IP_X$ of a positive polarity to the row electrodes $X_{2k+1}$ to $X_n$ belonging to row electrode set S3 of PDP 10. Immediately after this application of sustaining pulse $IP_X$, first sustaining driver 7 simultaneously applies a sustaining pulse $IP_Y$ of a positive polarity to the row electrodes $Y_{2k+1}$ to $Y_n$ belonging to the abovementioned row electrode set S3 (third emission sustaining process $I3_3$). By the execution of this third emission sustaining process $I3_3$, sustained discharge accompanying emission is caused twice only in the discharge cells, which belong to the abovementioned row electrode set S3 and are in the "emitting cell" state.

After the execution of the above-described fourth emission sustaining process $I4_1$, first emission sustaining process $I1_2$, and third emission sustaining process $I3_3$, address driver 6 extracts, from among the display drive data bits $DB2_{11}$_nm corresponding to subfield SF2, the data bits corresponding to the (2k+1)th to nth rows, in other words, $DB2_{(2k+1),\ 1-n,\ m}$. Address driver 6 then generates pixel data pulses of voltages corresponding to the respective logic levels of each of $DB2_{(2k+1),\ 1-n,\ m}$ and applies these data pulses successively to column electrodes $D_{1-m}$ as pixel data pulse sets $DP_{2k+1}$ to $DP_n$, each in correspondence to one row. Second sustaining driver 8 generates negative-polarity scan pulses SP, of the same pulse widths as the abovementioned pixel data pulses DP, in synchronization with each of the above pixel data pulse sets $DP_{2k+1}$ to $DP_n$ and applies these scan pulses SP successively to the row electrodes $Y_{2k+1}$ to $Y_n$ belonging to the row electrode set S3 (pixel data writing process $W_3$). In this pixel data writing process $W_3$, discharge (selective erasure discharge) occurs only in discharge cells belonging to the abovementioned row electrode set S3 to which scan pulses SP and the high-voltage pixel data pulses have been applied at the same time, and the residual wall charge in such discharge cells disappears. That is, the discharge cells belonging to the row electrode set S3, which had been initialized in the general reset process Rc to the "emitting cell" state, undergo the transition to "non-emitting cells." On the other hand, the abovementioned selective erasure discharge is not caused in discharge cells to which scan pulses SP have been applied but to which the low-voltage pixel data pulses have been applied as well, and these discharge cells are maintained in the condition initialized by the above-described general reset process Rc, that is, in the "emitting cell" state.

After the execution of the above-described pixel data writing process $W_3$, each of first sustaining driver 7 and second sustaining driver 8 applies the abovementioned sustaining pulses $IP_X$ and $IP_Y$ alternately and repeatedly to the row electrodes $Y_1$ to $Y_n$ and $X_1$ to $X_n$ of PDP 10 as shown in FIG. 20 (second emission sustaining process I2). By the execution of this second emission sustaining process I2, sustained discharge accompanying emission is caused repeatedly only in the discharge cells, among all discharge cells of PDP 10, that are in the "emitting cell" state.

After the execution of the above-described second emission sustaining process I2, the pixel data writing process $W_1$ in the next subfield SF3 is carried out in the same manner as in the above-described cases of subfields SF1 and SF2.

After the completion of this pixel data writing process $W_1$ in subfield SF3, the first emission sustaining process $I1_1$ is carried out in the same manner as in the above-described cases of subfields SF1 and SF2. Also, in the same time period as this first emission sustaining process $I1_1$, second sustaining driver 8 simultaneously applies a sustaining pulse $IP_X$ of a positive polarity to the row electrodes $X_{k+1}$ to $X_{2k}$ belonging to the row electrode set S2 of PDP 10. Immediately after this application of sustaining pulse $IP_X$, first sustaining driver 7 simultaneously applies a sustaining pulse $IP_Y$ of a positive polarity to the row electrodes $Y_{k+1}$ to $Y_{2k}$ belonging to row electrode set S2 of PDP 10 (third emission sustaining process $I3_2$). By the execution of this third emission sustaining process $I3_2$, sustained discharge accompanying emission is caused twice only in the discharge cells, which belong to the abovementioned row electrode set S2 and are in the "emitting cell" state.

Also at the same time as the above-described third emission sustaining process $I3_2$, second sustaining driver 8 simultaneously applies a sustaining pulse $IP_X$ of a positive polarity to the row electrodes $X_{2k+1}$ to $X_n$ belonging to row electrode set S3. Immediately after this application of sustaining pulse $IP_X$, first sustaining driver 7 simultaneously applies a sustaining pulse $IP_Y$ of a positive polarity to the row electrodes $Y_{2k+1}$ to $Y_n$ belonging to row electrode set S3 of PDP 10 (fourth emission sustaining process $I4_3$). By the execution of this fourth emission sustaining process $I4_3$, sustained discharge accompanying emission is caused twice only in the discharge cells, which belong to the abovementioned row electrode set S3 and are in the "emitting cell" state.

After the execution of the above-described third emission sustaining process $I3_2$ and the fourth emission sustaining process $I4_3$, the pixel data writing process $W_2$ in the next subfield SF3 is carried out.

After the completion of the abovementioned pixel data writing process $W_2$ in subfield SF3, the fourth emission sustaining process $I4_1$ and the first emission sustaining process $I1_2$ are carried out in the same manner as in the above-described cases of subfields SF1 and SF2.

Furthermore, after the completion of this pixel data writing process $W_2$, second sustaining driver 8 simultaneously applies a sustaining pulse $IP_X$ of a positive polarity to the row electrodes $X_{2k+1}$ to $X_n$ belonging to the row electrode set S3. Immediately after this application of sustaining pulse $IP_X$, first sustaining driver 7 simultaneously applies a sustaining pulse $IP_Y$ of a positive polarity to the row electrodes $Y_{2k+1}$ to $Y_n$ belonging to the abovementioned row electrode set S3 (third emission sustaining process $I3_3$). By the execution of this third emission sustaining process $I3_3$, sustained discharge accompanying emission is caused twice only in the discharge cells that belong to the abovementioned row electrode set S3 and are in the "emitting cell" state.

The operations performed in subfield 2 as shown in FIG. 20 are carried out in the same manner as described above in each of subfields SF3 to SF13 as well.

As shown in FIG. 21, the numbers of times by which sustaining pulses $IP_X$ and $IP_Y$ are applied repeatedly in the above-described second emission sustaining process I2 are set as follows for all row electrode sets S1 to S3;

SF2: 8
SF3: 16
SF4: 28
SF5: 36
SF6: 48
SF7: 60
SF8: 72
SF9: 84
SF10: 96
SF11: 108
SF12: 124
SF13: 136

Here as shown in FIGS. 19 and 21, the number of times the sustaining pulses $IP_X$ and $IP_Y$ are applied in the second emission sustaining process I2 in the last subfield SF14 of one field differs according to each of the row electrode sets S1 to S3. That is, the pulses are applied "152" times to row electrode set S1 (second emission sustaining process $I2_1$), "154" times to row electrode set S2 (second emission sustaining process $I2_2$), and "156" times to row electrode set S3 (second emission sustaining process $I2_3$). And in subfield SF14, the erasure process E, which eliminates all of the wall charge remaining in all discharge cells, is executed after the completion of the abovementioned second emission sustaining process $I2_3$.

Here as shown in FIG. 21, the total number of times of emission in each subfield will be the sum of the number of times of emission in each of the abovementioned first emission sustaining process I1, second emission sustaining process I2, third emission sustaining process I3, and fourth emission sustaining process I4. As shown in FIG. 21, since the number of times of emission in each of the first emission sustaining process I1, third emission sustaining process I3, and fourth emission sustaining process I4 is 2, the total number of times of emission in each of subfields SF1 to SF14 will be as follows:

SF1: 4
SF2: 12
SF3: 20
SF4: 32
SF5: 40
SF6: 52
SF7: 64
SF8: 76
SF9: 88
SF10: 100
SF11: 112
SF12: 128
SF13: 140
SF14: 156

Whether or not a discharge cell is to be made to emit light for the number of times such as shown above in each subfield, that is, whether to set a discharge cell to an "emitting cell" or to a "non-emitting cell" is determined by the data pattern of the display drive data GD shown in FIG. 13. With this display drive data GD, selective erasure discharge is made to occur only in the pixel data writing process W of one of the subfields among the subfields SF1 to SF14 as indicated by the filled circles of FIG. 13. That is, the wall charge that is formed in the general reset process Rc of the first subfield SF1 remains and the "emitting cell" state is maintained until the abovementioned selective erasure discharge is caused. Sustained discharge accompanying emission will thus be caused in the first emission sustaining process I1 to fourth emission sustaining process I4 in each subfield (indicated by the unfilled circles) existing in between. Here, the total of the number of times of sustained discharge carried out in each of subfields SF1 to SF14 is expressed as the emission luminance in one field. The emission luminance obtained by 15 types of display drive data GD, such as shown in FIG. 13, will thus be of the 15 gradations,

{0, 1, 4, 9, 16, 27, 40, 56, 75, 97, 122, 151, 182, 217, 256} when the emission luminance of subfield SF1 is expressed as "1."

As has been described above, the same 15-stage gradation drive realized by the emission drive formats shown in FIGS. 14 and 18 is realized by employing the emission drive format shown in FIG. 19. Also, as with the emission drive formats shown in FIGS. 14 and 18, since sustained emission is caused immediately prior to and immediately after execution of the pixel data writing process on one row electrode set, the respective pulse widths of scan pulses SP and pixel sustaining pulses IP can be made short.

Furthermore, with the emission drive format shown in FIG. 19, fourth emission sustaining process I4 is provided to make the time intervals between the respective emission sustaining processes, performed in dispersed manner in one subfield, to be made substantially the same in the driving of any of the row electrode sets S1 to S3. Since the amount of charged particles remaining in the discharge cells immediately prior to the application of a sustaining pulse IP will be substantially the same in the discharge cells belonging to any of row electrode sets S1 to S3, the emission luminosity that accompanies the sustained discharge in the respective screen areas allocated to each of row electrode sets S1 to S3 will be substantially the same. Image display of uniform luminosity can thus be realized on the screen of PDP 10.

However, with the emission drive format shown in FIG. 19, the time intervals between the point in time of the completion of the above-described general reset process Rc and the point in time of the start of each of priming processes $Pc_1$ to $Pc_3$ differ according to the row electrode sets S1 to S3. The amount of charged particles that remain in each discharge cell immediately prior to the start of each of priming processes $Pc_1$ to $Pc_3$ thus differs among the discharge cells belonging to each of row electrode set S1 to S3. Differences in luminosity thus arise in the emissions accompanying the priming discharge caused in the respective priming processes $Pc_1$ to $Pc_3$, and as a result, differences in luminosity arise between the upper area and lower area of the screen of PDP 10 during black display.

Figure 22:
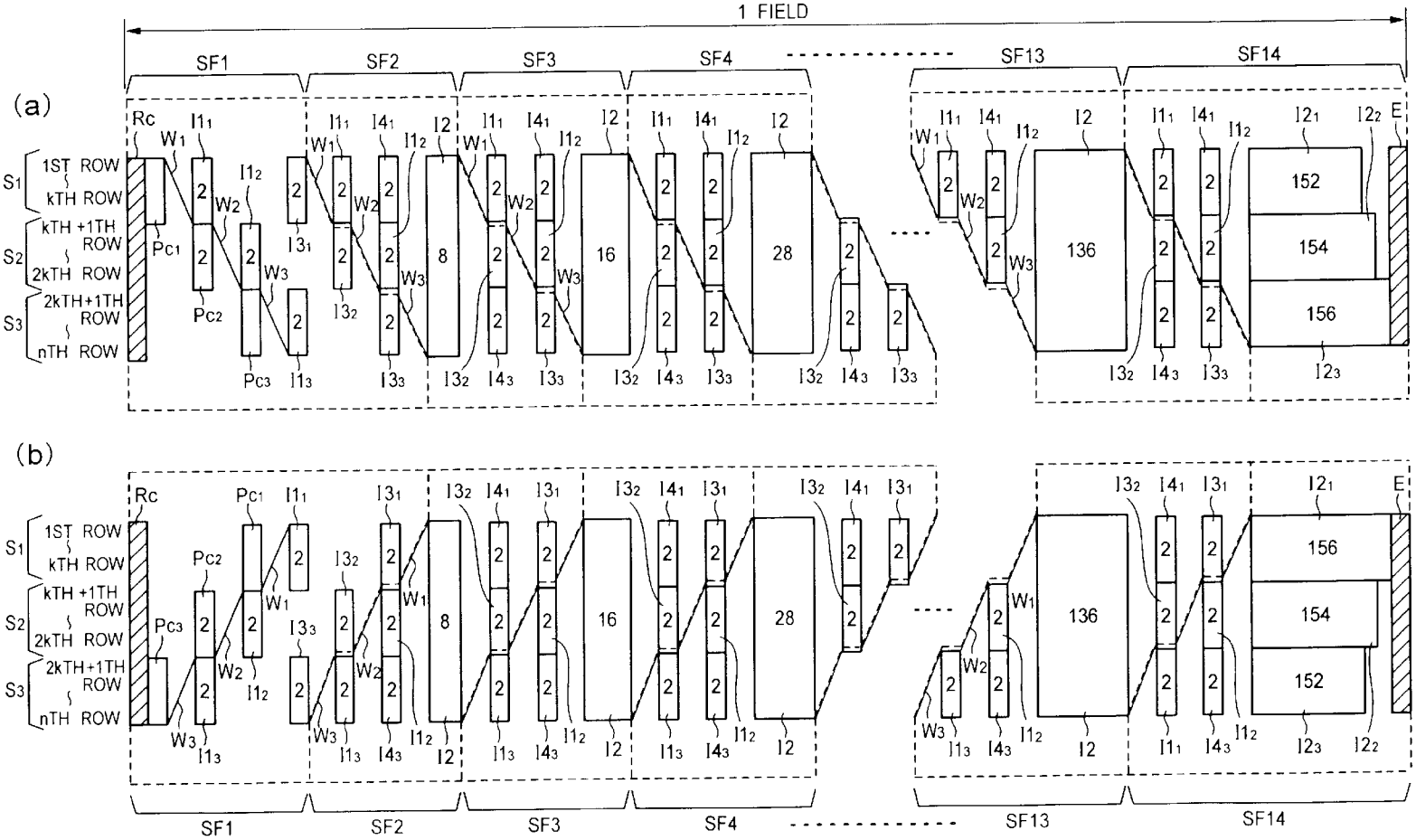
FIG. 22 is a diagram for explaining a drive method for lowering the luminance difference on the screen during a black display.

Thus in order to prevent differences in luminosity on the screen during black display, emission drive of PDP 10 is performed by switching alternately between the emission drive format shown in the (a) part of FIG. 22 and the emission drive format shown in the (b) part of FIG. 22 at each field.

The emission drive format of the (a) part of FIG. 22 is the same as that shown in FIG. 19 while the emission drive format of the (b) part of FIG. 22 is reversed in the screen scanning direction with respect to the format shown in FIG. 19. That is, whereas the writing of pixel data is carried out successively one row at a time from the 1st row to the nth row in the emission drive format shown in the (a) part of FIG. 22, the direction of writing of pixel data is reversed, that is, carried out from the nth row to the 1st row in the format of the (b) part of FIG. 22.

Figure 23:
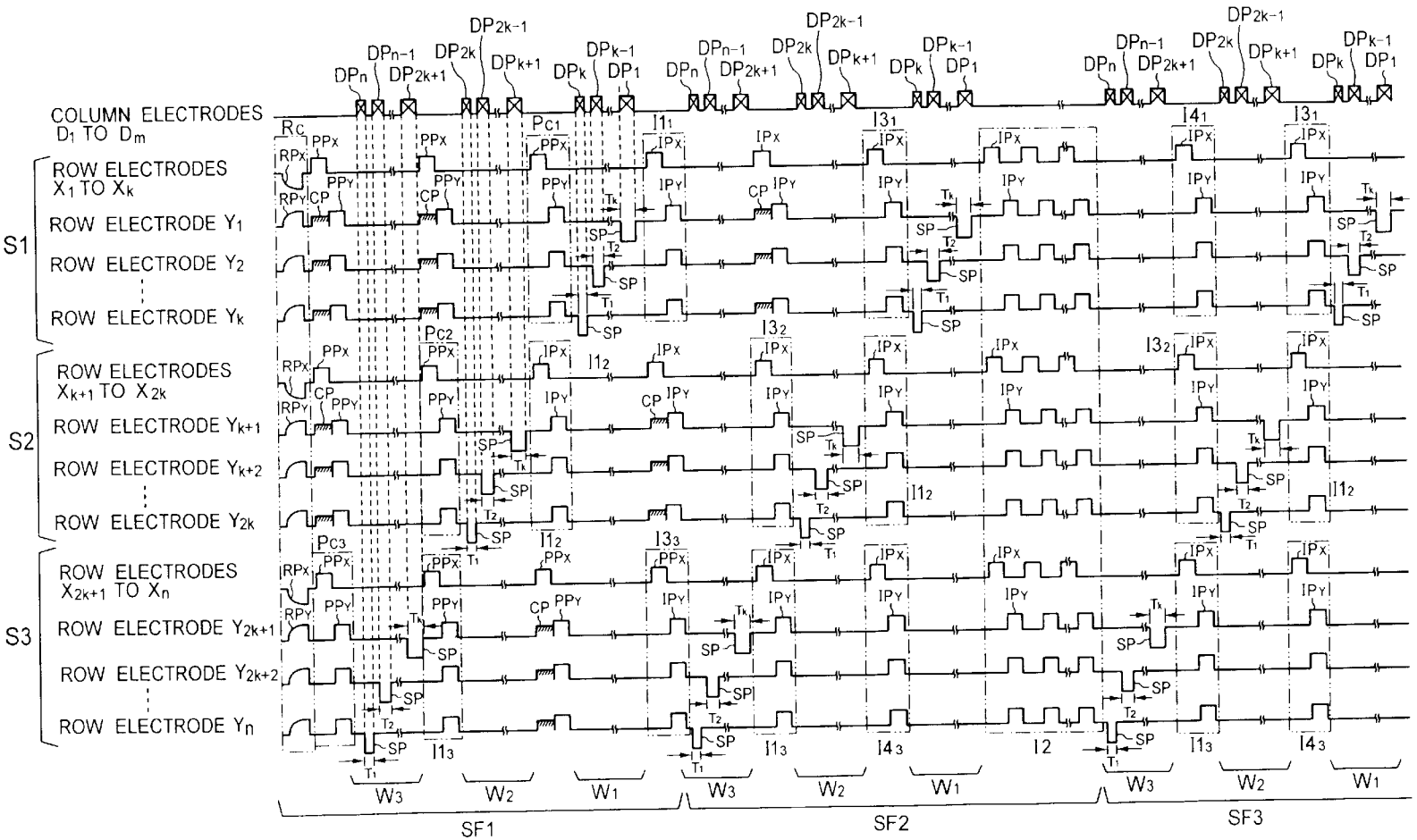
FIG. 23 is a diagram that shows part of the timings of application of the various drive pulses to be applied to the column electrodes and row electrodes of PDP 10 in accordance with the emission drive format shown in (a) of FIG. 22.

FIG. 23 is a diagram that shows the timing of application of the various drive pulses that are applied in the respective processes in accordance with the emission drive format shown in the (b) part of FIG. 22. As with FIG. 20, only the operations in the subfields SF1 and SF2 are excerpted and shown in FIG. 23. Here, the types of the drive pulses applied in the respective processes and the types and actions of the discharge caused by the application of such drive pulses in FIG. 23 are the same as those shown in FIG. 20.

With the drive method illustrated in FIG. 22, since switching between the condition where the upper area of the screen of PDP 10 becomes darker than the lower area and the condition where the upper area becomes brighter is performed in each field, luminosity differences between the two areas will not be perceived even during black display or low luminosity display. The priming processes $Pc_1$ to $Pc_3$ and the first emission sustaining processes $I1_1$ to $I1_3$, which are executed in the subfield SF1 of FIGS. 19 and 22, may be omitted and the number of times of sustained emission to be carried out in each of the third emission sustaining processes $I3_1$ to $I3_2$ may be set to four. In this case, since the priming process itself is eliminated, the above-described luminosity differences during black display will obviously not occur.

As has been described in detail above, with the present invention, each time the pixel data writing of one display line group among the plurality of display lines of PDP is completed, a sustained discharge operation is executed on each of the emitting cells belonging to that display line group.

Thus, the charged particles in the discharge cells, which have been generated in the process of pixel data writing but have decreased with the lapse of time, are reformed by the abovementioned sustained discharge. Accordingly erroneous discharge is made difficult to occur, enabling good image displays to be obtained even when the pulse widths of the drive pulses to be applied to the PDP thereafter are made short.

What is claimed is:

1. A plasma display panel drive method for driving a plasma display panel in which a discharge cell, corresponding to one pixel, is formed at each intersection of row electrodes, each corresponding to each of a plurality of display lines, and column electrodes which are aligned so as to intersect with said row electrodes, said plasma display panel drive method comprising:

grouping said plurality of display lines into a plurality of display line groups;

executing a reset process, by which reset discharge is made to occur to initialize all of said discharge cells to an emitting cell state, only in the first of a plurality of display period divisions that constitute a unit display period for an input video signal, in each of said display period divisions, executing a pixel data writing process, by which each of said discharge cells is set to either said emitting cell state or a non-emitting cell state in accordance with pixel data corresponding to said input video signal, and executing an emission sustaining process, by which sustained discharge is caused so that emitting cells belonging to one of said plurality of display line groups is made to emit light, between executions, in the same display period division, of said pixel data writing process for said discharge cells belonging to said one of said plurality of display line groups and said pixel data writing process for said discharge cells belonging to another one of said plurality of display line groups.

2. A plasma display panel drive method as set forth in claim 1, wherein selective erasure discharge, by which said discharge cells are set to said non-emitting cell state, is made to occur in only said pixel data writing process in one of said display period divisions within said unit display period.

3. A plasma display panel drive method as set forth in claim 1, wherein in said first display period division, a priming process, by which priming discharge is made to occur, is executed on each of said discharge cells belonging to one display line group among said display line groups immediately prior to executing said pixel data writing process on said discharge cells belonging to said one display line group.

4. A plasma display panel drive method as set forth in claim 1, wherein in each of said display period divisions said pixel data writing process and said emission sustaining process are executed respectively for each of said display line groups, so that a process of executing said pixel data writing process and said emission sustaining process is repeated until drivings of all of said display line groups are completed.

5. A plasma display panel drive method for driving a plasma display panel in which a discharge cell, corresponding to one pixel, is formed at each intersection of row electrodes, each corresponding to each of a plurality of display lines, and column electrodes which are aligned so as to intersect with said row electrodes, said plasma display panel drive method comprising:

executing a reset process, by which reset discharge is made to occur to initialize all of said discharge cells to an emitting cell state, only in the first of a plurality of display period divisions that constitute a unit display period for an input video signal, executing, in each of said display period divisions, a pixel data writing process, by which each of said discharge cells is set to either said emitting cell state or a non-emitting cell state in accordance with pixel data corresponding to said input video signal, and an emission sustaining process, by which sustained discharge is caused to make emitting cells belonging to one display line group, is made to emit light each time said pixel data writing process for said discharge cells belonging to said one display line group among a plurality of display line groups that constitute said display lines is completed, wherein in each of said display period divisions with the exception of said first display period division, a second emission sustaining process, by which sustained discharge is made to occur in all of said emitting cells at once, is executed at the end of said emission sustaining process.

6. A plasma display panel drive method for driving a plasma display panel in which a discharge cell, corresponding to one pixel, is formed at each intersection of row electrodes, each corresponding to each of a plurality of display lines, and column electrodes which are aligned so as to intersect with said row electrodes, said plasma display panel drive method comprising:

executing a reset process, by which reset discharge is made to occur to initialize all of said discharge cells to an emitting cell state, only in the first of a plurality of display period divisions that constitute a unit display period for an input video signal, executing, in each of said display period divisions, a pixel data writing process, by which each of said discharge cells is set to either said emitting cell state or a non-emitting cell state in accordance with pixel data corresponding to said input video signal, and an emission sustaining process, by which sustained discharge is caused to make emitting cells belonging to one display line group, is made to emit light each time said pixel data writing process for said discharge cells belonging to said one display line group among a plurality of display line groups that constitute said display lines is completed, wherein in each of said display period divisions with the exception of said first display period division, a third emission sustaining process, by which sustained discharge is made to occur to cause said emitting cells belonging to one display line group among said display line groups to emit light, is executed immediately before the execution of said pixel data writing process on said display cells belonging to said one display line group.

7. A plasma display panel drive method for performing a gradation drive, in accordance with an input video signal, of a plasma display panel, in which a discharge cell corresponding to one pixel is formed at each intersection of row electrodes each corresponding to each of a plurality of display lines, and column electrodes which are aligned so as to intersect with said row electrodes, said plasma display panel drive method comprising:

grouping said plurality of display lines into a plurality of display line groups;

executing a reset process, by which reset discharge is made to occur to initialize all of said discharge cells to an emitting cell state, only in the first of a plurality of display period divisions that comprise a unit display period for said input video signal; and executing, in each of said display period divisions, a pixel data writing process by which each of said discharge cells is set to either said emitting cell state or non-emitting cell state in accordance with pixel data for each pixel based on said input video signal while scanning each of said discharge cells along each of said display lines, a first emission sustaining process, by which sustained discharge which causes light emission by emitting cells belonging to one of said display line groups, is made to occur a predetermined number of times each time the execution of said pixel data writing process on discharge cells belonging to said one of said display line groups is completed, and a second emission sustaining process in which said sustained discharge causing all of said emitting cells in the whole plasma display panel to emit light at once is repeated a number of times that corresponds to the weighing of each display period division.

8. A plasma display panel drive method as set forth in claim 7, wherein said first emission sustaining process is performed between said pixel data writing process of said one display line group and said pixel data writing process of another display line group.

9. A plasma display panel drive method for performing a gradation drive, in accordance with an input video signal, of a plasma display panel, in which a discharge cell corresponding to one pixel is formed at each intersection of row electrodes each corresponding to each of a plurality of display lines, and column electrodes which are aligned so as to intersect with said row electrodes, said plasma display panel drive method comprising:

executing a reset process, by which reset discharge is made to occur to initialize all of said discharge cells to an emitting cell state, only in the first of a plurality of display period divisions that comprise a unit display period for said input video signal; and executing, in each of said display period divisions, a pixel data writing process by which each of said discharge cells is set to either said emitting cell state or non-emitting cell state in accordance with pixel data for each pixel based on said input video signal while scanning each of said discharge cells along each of said display lines, a first emission sustaining process, by which sustained discharge which causes light emission by emitting cells belonging to one display line group, is made to occur a predetermined number of times each time the execution of said pixel data writing process on discharge cells belonging to said one display line group among display line groups each comprised a plurality of display lines is completed, and a second emission sustaining process, in which said sustained discharge which causes all said emitting cells to emit light at once is made to occur a number of times that corresponds to the weighing of each display period division, wherein immediately before the execution of said pixel data writing process on said discharge cells belonging to one display line group among said display line groups, a third emission sustaining process, by which said sustained discharge is made to occur to cause emission of said emitting cells belonging to said one display line group, is furthermore executed.

10. A plasma display panel drive method as set forth in claim 9, wherein in the same time periods as said first emission sustaining process and said third emission sustaining process, a fourth emission sustaining process, by which sustained discharge is made to occur to cause light emission by said emitting cells belonging to at least one display line group besides the display line groups on which each of said first emission sustaining process and said third emission sustaining process is executed, is furthermore executed.

11. A plasma display panel drive method for performing a gradation drive, in accordance with an input video signal, of a plasma display panel, in which a discharge cell corresponding to one pixel is formed at each intersection of row electrodes each corresponding to each of a plurality of display lines, and column electrodes which are aligned so as to intersect with said row electrodes, said plasma display panel drive method comprising:

executing a reset process, by which reset discharge is made to occur to initialize all of said discharge cells to an emitting cell state, only in the first of a plurality of display period divisions that comprise a unit display period for said input video signal; and executing, in each of said display period divisions, a pixel data writing process by which each of said discharge cells is set to either said emitting cell state or non-emitting cell state in accordance with pixel data for each pixel based on said input video signal while scanning each of said discharge cells along each of said display lines, a first emission sustaining process, by which sustained discharge which causes light emission by emitting cells belonging to one display line group, is made to occur a predetermined number of times each time the execution of said pixel data writing process on discharge cells belonging to said one display line group among display line groups each comprised a plurality of display lines is completed, and a second emission sustaining process, in which said sustained discharge which causes all said emitting cells to emit light at once is made to occur a number of times that corresponds to the weighing of each display period division, wherein in the same time periods as said first emission sustaining process and a third emission sustaining process, by which said sustained discharge is made to occur to cause emission of said emitting cells belonging to said one display line group, is furthermore executed immediately before the execution of said pixel data writing process on said discharge cells belonging to one display line group among said display line groups, a fourth emission sustaining process, by which sustained discharge is made to occur to cause light emission by said emitting cells belonging to at least one display line group besides the display line groups on which each of said first emission sustaining process and said third emission sustaining process is executed, is furthermore executed.

12. A plasma display panel drive method for performing a gradation drive, in accordance with an input video signal, of a plasma display panel, in which a discharge cell corresponding to one pixel is formed at each intersection of row electrodes each corresponding to each of a plurality of display lines, and column electrodes which are aligned so as to intersect with said row electrodes, said plasma display panel drive method comprising:

executing a reset process, by which reset discharge is made to occur to initialize all of said discharge cells to an emitting cell state, only in the first of a plurality of display period divisions that comprise a unit display period for said input video signal; and executing, in each of said display period divisions, a pixel data writing process by which each of said discharge cells is set to either said emitting cell state or non-emitting cell state in accordance with pixel data for each pixel based on said input video signal while scanning each of said discharge cells along each of said display lines, a first emission sustaining process, by which sustained discharge which causes light emission by emitting cells belonging to one display line group, is made to occur a predetermined number of times each time the execution of said pixel data writing process on discharge cells belonging to said one display line group among display line groups each comprised a plurality of display lines is completed, and a second emission sustaining process, in which said sustained discharge which causes all said emitting cells to emit light at once is made to occur a number of times that corresponds to the weighing of each display period division, wherein the direction of said scanning of each of said display lines is changed in each field in said pixel data writing process.

* * * * *